US008787779B2

(12) United States Patent
Kayahara

(10) Patent No.: US 8,787,779 B2
(45) Date of Patent: Jul. 22, 2014

(54) IMAGE FORMING APPARATUS

(75) Inventor: Yasufumi Kayahara, Tokyo (JP)

(73) Assignee: Canon Finetech Inc., Misato-shi (JP)

( * ) Notice: Subject to any disclaimer, the term of this patent is extended or adjusted under 35 U.S.C. 154(b) by 210 days.

(21) Appl. No.: 13/268,157

(22) Filed: Oct. 7, 2011

(65) Prior Publication Data

US 2012/0106990 A1 May 3, 2012

(30) Foreign Application Priority Data

Oct. 28, 2010 (JP) ..... 2010-242038

(51) Int. Cl.
*G03G 15/08* (2006.01)

(52) U.S. Cl.
USPC ..... 399/27; 399/61

(58) Field of Classification Search
USPC ..... 399/9, 24–30, 58, 61–65, 258–263
See application file for complete search history.

(56) References Cited

U.S. PATENT DOCUMENTS

| | | | | |
|---|---|---|---|---|
| 7,734,206 | B2 * | 6/2010 | Ishida | 399/58 |
| 7,764,887 | B2 * | 7/2010 | Kasai | 399/27 |
| 2005/0207765 | A1 * | 9/2005 | Ogata | 399/27 |
| 2006/0029405 | A1 * | 2/2006 | Tanaka et al. | 399/27 |
| 2006/0051110 | A1 * | 3/2006 | Koyama | 399/27 |
| 2007/0217798 | A1 * | 9/2007 | Tsuji et al. | 399/27 |
| 2007/0253720 | A1 * | 11/2007 | Kasai | 399/27 |
| 2009/0232524 | A1 | 9/2009 | Takahashi et al. | |
| 2009/0304399 | A1 * | 12/2009 | Morikuni | 399/27 |
| 2010/0247118 | A1 * | 9/2010 | Sakamoto et al. | 399/27 |
| 2011/0158669 | A1 | 6/2011 | Kayahara | |

FOREIGN PATENT DOCUMENTS

| | | | |
|---|---|---|---|
| JP | 62-7070 | A | 1/1987 |
| JP | 11-15249 | A | 1/1999 |
| JP | 2000-89554 | A | 3/2000 |
| JP | 2003-280355 | A | 10/2003 |
| JP | 2005-099143 | A | 4/2005 |
| JP | 2006-091589 | A | 4/2006 |
| JP | 2008-39967 | A | 2/2008 |
| JP | 2010-054794 | A | 3/2010 |
| WO | 2007/091507 | A1 | 8/2007 |

OTHER PUBLICATIONS

Office Action issued Dec. 31, 2012, in Chinese Application No. 201110332337.9.
Notification of Reason for Refusal dispatched Jan. 22, 2013, in Japanese Application No. 2010-242038.
Japanese Office Action dated Apr. 30, 2013, in related Japanese Patent Application No. 2010-242038 (with English translation).

* cited by examiner

*Primary Examiner* — Hoan Tran
(74) *Attorney, Agent, or Firm* — Fitzpatrick, Cella, Harper & Scinto

(57) ABSTRACT

An image forming apparatus which has an improved follow-up property indicating how a toner supply amount follows a toner consumption amount to prevent a defective image, including: a photosensitive drum; a developing device; a toner replenishing device; a toner sensor configured to detect a toner amount inside the developing device; and a controller configured to drive the toner replenishing device to replenish the developing device with toner based on a detection result of the sensor during a developing device driving time and to stop the toner replenishing device during a non-image forming period to stop replenishing the developing device with toner, wherein if the toner amount inside the developing device detected by the sensor is reduced to a level equal to or lower than a predetermined threshold value, the controller drives the developing device and the toner replenishing device even during the non-image forming period.

8 Claims, 19 Drawing Sheets

FIG. 4A

COVERAGE RATE: 50%=0.5

| SIZE OF TRANSFERRING MATERIAL | LENGTH IN CONVEYING DIRECTION (mm) | PROCESS SPEED (mm/sec) | TIME IN TRANSFERRING MATERIAL (sec) | TIME OF NO DEVELOPING DRIVE IN INTER-TRANSFERRING-MATERIAL GAP (sec) | DEVELOPING DEVICE DRIVING TIME (sec/SHEET) | TONER CONSUMPTION AMOUNT PER SHEET (g) | TONER SUPPLY AMOUNT (g) 1.0g/sec | |
|---|---|---|---|---|---|---|---|---|
| | | | | | | | MAXIMUM | MINIMUM |
| A4 | 210 (A4 LONG EDGE FEED) | 135 | 1.56 | 0.14 | 1.56 | 0.50 | 1.00 | 0.56 |
| | | 230 | 0.91 | 0.09 | 0.91 | 0.50 | 0.50 | 0.41 |
| | | 310 | 0.68 | 0.08 | 0.68 | 0.50 | 0.50 | 0.18 |
| A3 | 420 (A3 SHORT EDGE FEED) | 135 | 3.11 | 0.14 | 3.11 | 1.00 | 1.61 | 1.50 |
| | | 230 | 1.83 | 0.09 | 1.83 | 1.00 | 1.50 | 0.83 |
| | | 310 | 1.35 | 0.08 | 1.35 | 1.00 | 0.84 | 0.50 |

FIG. 4B

| NUMBER OF PRINTED SHEET | TONER CONSUMPTION AMOUNT (g) | 135mm/sec | | | | 230mm/sec | | | | 310mm/sec | | | |
|---|---|---|---|---|---|---|---|---|---|---|---|---|---|
| | | TONER SUPPLY AMOUNT | Δ | TONER AMOUNT | % | TONER SUPPLY AMOUNT | Δ | TONER AMOUNT | % | TONER SUPPLY AMOUNT | Δ | TONER AMOUNT | % |
| 10 | 5 | 7.78 | 2.78 | 199.6 | 100% | 4.57 | -0.44 | 199.6 | 100% | 3.39 | -1.62 | 198.4 | 99% |
| 20 | 10 | 15.56 | 5.56 | 199.1 | 100% | 9.13 | -0.87 | 199.1 | 100% | 6.77 | -3.23 | 196.8 | 98% |
| 30 | 15 | 23.34 | 8.34 | 198.7 | 100% | 13.70 | -1.31 | 198.7 | 99% | 10.16 | -4.85 | 195.2 | 98% |
| 40 | 20 | 31.12 | 11.12 | 198.3 | 100% | 18.26 | -1.74 | 198.3 | 99% | 13.54 | -6.46 | 193.5 | 97% |
| 50 | 25 | 38.90 | 13.90 | 197.8 | 100% | 22.83 | -2.18 | 197.8 | 99% | 16.93 | -8.08 | 191.9 | 96% |
| 100 | 50 | 77.80 | 27.80 | 195.7 | 100% | 45.65 | -4.35 | 195.7 | 98% | 33.85 | -16.15 | 183.9 | 92% |
| 150 | 75 | 116.70 | 41.70 | 193.5 | 100% | 68.48 | -6.52 | 193.5 | 97% | 50.78 | -24.23 | 175.8 | 88% |
| 200 | 100 | 155.60 | 55.60 | 191.3 | 100% | 91.30 | -8.70 | 191.3 | 96% | 67.70 | -32.30 | 167.7 | 84% |
| 300 | 150 | 233.40 | 83.40 | 187.0 | 100% | 136.95 | -13.05 | 187.0 | 93% | 101.55 | -48.45 | 151.6 | 76% |
| 400 | 200 | 311.20 | 111.20 | 182.6 | 100% | 182.60 | -17.40 | 182.6 | 91% | 135.40 | -64.60 | 135.4 | 68% |
| 500 | 250 | 389.00 | 139.00 | 178.3 | 100% | 228.25 | -21.75 | 178.3 | 89% | 169.25 | -80.75 | 119.3 | 60% |

FIG. 6A

COVERAGE RATE: 50%=0.5

| SIZE OF TRANSFERRING MATERIAL | LENGTH IN CONVEYING DIRECTION (mm) | PROCESS SPEED (mm/sec) | TIME IN TRANSFERRING MATERIAL (sec) | TIME OF DEVELOPING DRIVE IN INTER-TRANSFERRING-MATERIAL GAP (sec) | DEVELOPING DEVICE DRIVING TIME (sec/SHEET) | TONER CONSUMPTION AMOUNT PER SHEET (g) | TONER SUPPLY AMOUNT (g) 1.0g/sec | |
|---|---|---|---|---|---|---|---|---|
| | | | | | | | MAXIMUM | MINIMUM |
| A4 | 210 (A4 LONG EDGE FEED) | 135 | 1.56 | 0.14 | 1.70 | 0.50 | 1.20 | 0.70 |
| | | 230 | 0.91 | 0.09 | 1.00 | 0.50 | 0.50 | 0.50 |
| | | 310 | 0.68 | 0.08 | 0.76 | 0.50 | 0.50 | 0.26 |
| A3 | 420 (A3 SHORT EDGE FEED) | 135 | 3.11 | 0.14 | 3.25 | 1.00 | 1.75 | 1.50 |
| | | 230 | 1.83 | 0.09 | 1.92 | 1.00 | 1.50 | 0.92 |
| | | 310 | 1.35 | 0.08 | 1.43 | 1.00 | 0.93 | 0.50 |

FIG. 6B

| NUMBER OF PRINTED SHEET | TONER CONSUMPTION AMOUNT (g) | 135mm/sec | | | | 230mm/sec | | | | 310mm/sec | | | |
|---|---|---|---|---|---|---|---|---|---|---|---|---|---|
| | | TONER SUPPLY AMOUNT | Δ | TONER AMOUNT | % | TONER SUPPLY AMOUNT | Δ | TONER AMOUNT | % | TONER SUPPLY AMOUNT | Δ | TONER AMOUNT | % |
| 10 | 5 | 9.50 | 4.50 | 200.0 | 100% | 5.00 | 0.00 | 200.0 | 100% | 3.80 | -1.20 | 198.8 | 99% |
| 20 | 10 | 19.00 | 9.00 | 200.0 | 100% | 10.00 | 0.00 | 200.0 | 100% | 7.60 | -2.40 | 197.6 | 99% |
| 30 | 15 | 28.50 | 13.50 | 200.0 | 100% | 15.00 | 0.00 | 200.0 | 100% | 11.40 | -3.60 | 196.4 | 98% |
| 40 | 20 | 38.00 | 18.00 | 200.0 | 100% | 20.00 | 0.00 | 200.0 | 100% | 15.20 | -4.80 | 195.2 | 98% |
| 50 | 25 | 47.50 | 22.50 | 200.0 | 100% | 25.00 | 0.00 | 200.0 | 100% | 19.00 | -6.00 | 194.0 | 97% |
| 100 | 50 | 95.00 | 45.00 | 200.0 | 100% | 50.00 | 0.00 | 200.0 | 100% | 38.00 | -12.00 | 188.0 | 94% |
| 150 | 75 | 142.50 | 67.50 | 200.0 | 100% | 75.00 | 0.00 | 200.0 | 100% | 57.00 | -18.00 | 182.0 | 91% |
| 200 | 100 | 190.00 | 90.00 | 200.0 | 100% | 100.00 | 0.00 | 200.0 | 100% | 76.00 | -24.00 | 176.0 | 88% |
| 300 | 150 | 285.00 | 135.00 | 200.0 | 100% | 150.00 | 0.00 | 200.0 | 100% | 114.00 | -36.00 | 164.0 | 82% |
| 400 | 200 | 380.00 | 180.00 | 200.0 | 100% | 200.00 | 0.00 | 200.0 | 100% | 152.00 | -48.00 | 152.0 | 76% |
| 500 | 250 | 475.00 | 225.00 | 200.0 | 100% | 250.00 | 0.00 | 200.0 | 100% | 190.00 | -60.00 | 140.0 | 70% |

| FIG. 8A | FIG. 8B |
|---|---|

FIG. 9A

COVERAGE RATE: 50%=0.5

| SIZE OF TRANSFERRING MATERIAL | LENGTH IN CONVEYING DIRECTION (mm) | PROCESS SPEED (mm/sec) | TIME IN TRANSFERRING MATERIAL (sec) | TIME OF DEVELOPING DRIVE IN INTER-TRANSFERRING-MATERIAL GAP (sec) | DEVELOPING DEVICE DRIVING TIME (sec/SHEET) | TONER CONSUMPTION AMOUNT PER SHEET (g) | TONER SUPPLY AMOUNT (g) 1.0g/sec | | TONER REPLENISHING AMOUNT AFTER PRINT (g) |
|---|---|---|---|---|---|---|---|---|---|
| | | | | | | | MAXIMUM | MINIMUM | |
| A4 | 210 (A4 LONG EDGE FEED) | 135 | 1.56 | 0.14 | 6.70 | 0.50 | 1.20 | 0.70 | +5 |
| | | 230 | 0.91 | 0.09 | 6.00 | 0.50 | 0.50 | 0.50 | +5 |
| | | 310 | 0.68 | 0.08 | 5.76 | 0.50 | 0.50 | 0.26 | +5 |
| A3 | 420 (A3 SHORT EDGE FEED) | 135 | 3.11 | 0.14 | 8.25 | 1.00 | 1.75 | 1.50 | +5 |
| | | 230 | 1.83 | 0.09 | 6.92 | 1.00 | 1.50 | 0.92 | +5 |
| | | 310 | 1.35 | 0.08 | 6.43 | 1.00 | 0.93 | 0.50 | +5 |

FIG. 9B

| NUMBER OF PRINTED SHEET | TONER CONSUMPTION AMOUNT (g) | 135mm/sec | | | | 230mm/sec | | | | 310mm/sec | | | |
|---|---|---|---|---|---|---|---|---|---|---|---|---|---|
| | | TONER SUPPLY AMOUNT | Δ | TONER AMOUNT | % | TONER SUPPLY AMOUNT | Δ | TONER AMOUNT | % | TONER SUPPLY AMOUNT | Δ | TONER AMOUNT | % |
| 10 | 5 | 9.50 | 4.50 | 200.0 | 100% | 5.00 | 0.00 | 200.0 | 100% | 3.80 | 3.80 | 203.8 | 100% |
| 20 | 10 | 19.00 | 9.00 | 200.0 | 100% | 10.00 | 0.00 | 200.0 | 100% | 7.60 | 2.60 | 202.6 | 100% |
| 30 | 15 | 28.50 | 13.50 | 200.0 | 100% | 15.00 | 0.00 | 200.0 | 100% | 11.40 | 1.40 | 201.4 | 100% |
| 40 | 20 | 38.00 | 18.00 | 200.0 | 100% | 20.00 | 0.00 | 200.0 | 100% | 15.20 | 0.20 | 200.2 | 100% |
| 50 | 25 | 47.50 | 22.50 | 200.0 | 100% | 25.00 | 0.00 | 200.0 | 100% | 19.00 | -1.00 | 199.0 | 100% |
| 100 | 50 | 95.00 | 45.00 | 200.0 | 100% | 50.00 | 0.00 | 200.0 | 100% | 38.00 | -7.00 | 193.0 | 97% |
| 150 | 75 | 142.50 | 67.50 | 200.0 | 100% | 75.00 | 0.00 | 200.0 | 100% | 57.00 | -13.00 | 187.0 | 94% |
| 200 | 100 | 190.00 | 90.00 | 200.0 | 100% | 100.00 | 0.00 | 200.0 | 100% | 76.00 | -19.00 | 181.0 | 91% |
| 300 | 150 | 285.00 | 135.00 | 200.0 | 100% | 150.00 | 0.00 | 200.0 | 100% | 114.00 | -31.00 | 169.0 | 85% |
| 400 | 200 | 380.00 | 180.00 | 200.0 | 100% | 200.00 | 0.00 | 200.0 | 100% | 152.00 | -43.00 | 157.0 | 79% |
| 500 | 250 | 475.00 | 225.00 | 200.0 | 100% | 250.00 | 0.00 | 200.0 | 100% | 190.00 | -55.00 | 145.0 | 73% |

| FIG. 11A | FIG. 11B |
|---|---|

| FIG. 12A | FIG. 12B |
|---|---|

IMAGE FORMING APPARATUS

BACKGROUND OF THE INVENTION

1. Field of the Invention

The present invention relates to an image forming apparatus including a developing device and a toner replenishing device configured to replenish the developing device with toner.

2. Description of the Related Art

An image forming apparatus of an electrophotographic process includes a developing device for developing an electrostatic image with toner, the electrostatic image being formed on a surface of a photosensitive drum by an exposure device. When images are continuously formed on a plurality of sheets of transferring materials, an "image area" corresponding to a range of each of the transferring materials in which the electrostatic image is formed on the surface of the photosensitive drum and a "non-image area" corresponding to a range between a transferring material and a transferring material are formed on the surface of the photosensitive drum. A developing roller provided in the developing device is caused to rotate without distinction between the "image area" and the "non-image area" of the surface of the photosensitive drum, and when the "image area" passes therethrough, the electrostatic image is developed with toner according to a developing bias.

In contrast, Japanese Patent Application Laid-Open No. 2008-39967 discloses a developing device in which a developing roller is caused to rotate while the "image area" on a photosensitive drum is passing therethrough, but the developing roller is stopped while the "non-image area" on the photosensitive drum is passing therethrough. According to this configuration, wear and degradation of a developer is reduced compared to the developing device in which the developing roller keeps rotating at all times.

However, as in the developing device disclosed in Japanese Patent Application Laid-Open No. 2008-39967, the following problem can be raised with such a configuration that the developing roller is caused to rotate while the "image area" on the photosensitive drum is passing therethrough but the developing roller is stopped while the "non-image area" on the photosensitive drum is passing therethrough.

That is, in the developing device disclosed in Japanese Patent Application Laid-Open No. 2008-39967, the developing roller is rotated only while the "image area" on the photosensitive drum is passing therethrough, and the toner replenishing device is driven to replenish the developing device with toner while the developing roller is rotated. If a process speed of the image forming apparatus increases as in recent years, a time required by the "image area" on the photosensitive drum to pass through the developing roller is reduced, or a rotation time of the developing roller is reduced. As a result, a drive time of the toner replenishing device is reduced, which reduces a time to supply toner. If the time to supply toner is thus reduced, there is a fear that a "toner supply amount" that is an amount of toner supplied to the developing device cannot follow a "toner consumption amount" that is an amount of toner consumed by the developing device and a defective image may be generated due to lack of toner.

SUMMARY OF THE INVENTION

In view of the above-mentioned circumstances, an object of the present invention is to provide an image forming apparatus capable of suppressing generation of a defective image by improving a follow-up property indicating how a toner supply amount follows a toner consumption amount.

In order to solve the above-mentioned problem, an image forming apparatus according to the present invention, including: an image bearing member on which an electrostatic image is formed; a developing unit configured to develop the electrostatic image formed on the image bearing member with toner carried by a developing roller; a toner replenishing unit configured to replenish the developing unit with the toner; a detecting unit configured to detect presence or absence of the toner inside the developing unit; and a control unit configured to control the toner replenishing unit to perform a toner replenishing operation based on detection results of the detecting unit, wherein the control unit drives the developing unit during an image forming period during which the developing roller is opposed to an image area in which the electrostatic image is formed on the image bearing member, and stops rotation drive of the developing unit during a non-image forming period during which the developing roller is opposed to a non-image area in which the electrostatic image is not formed on the image bearing member, wherein the control unit drives the developing unit and causes the toner replenishing unit to perform the toner replenishing operation based on the detection results of the detecting unit during the image forming period until a state of toner absence is continuously detected by the detecting unit a predetermined number of times, and inhibits the toner replenishing operation during the non-image forming period, and wherein, in a case where the state of toner absence is continuously detected by the detecting unit the predetermined number of times, the control unit drives the developing unit also during the non-image forming period and further causes the toner replenishing unit to perform the toner replenishing operation based on the detection results of the detecting unit.

Further features of the present invention will become apparent from the following description of exemplary embodiments with reference to the attached drawings.

BRIEF DESCRIPTION OF THE DRAWINGS

FIG. 4A is a table showing a length in a conveying direction, a process speed, a time in a transferring material, and a time of no developing drive in an inter-transferring-material gap with regard to transferring materials of A4 size and A3 size used in an image forming apparatus according to a comparison example.

FIG. 4B is a table showing the number of printed sheets and a toner consumption amount along with the number of printed sheets and a toner consumption amount per sheet (g) for cases of 135 mm/sec, 230 mm/sec, and 310 mm/sec with regard to the transferring material of A4 size.

FIG. 6A is a table showing the length in the conveying direction, the process speed, the time in the transferring material, and a time of developing drive in the inter-transferring-material gap with regard to the transferring materials of A4 size and A3 size.

FIG. 6B is a table showing the number of printed sheets and the toner consumption amount along with the number of printed sheets and the toner consumption amount per sheet (g) for the cases of 135 mm/sec, 230 mm/sec, and 310 mm/sec with regard to a transferring material P of A4 size.

FIG. 9A is a table showing the length in the conveying direction, the process speed, the time in the transferring material, and the time of developing drive in the inter-transferring-material gap with regard to the transferring materials of A4 size and A3 size.

FIG. 9B is a table showing the number of printed sheets and the toner consumption amount along with the number of printed sheets and the toner consumption amount per sheet (g) for the cases of 135 mm/sec, 230 mm/sec, and 310 mm/sec with regard to the transferring material P of A4 size.

DESCRIPTION OF THE EMBODIMENTS

Hereinafter, a mode for carrying out the present invention is exemplarily described in detail based on embodiments with reference to the accompanying drawings. Note that, dimensions, materials, and shapes of construction parts described in those embodiments and relative positions thereof are appropriately changed according to a construction of an apparatus to which the present invention is applied and various conditions, and hence the scope of the present invention is not to be limited only thereto unless otherwise specified.

First Embodiment

Figure 1:
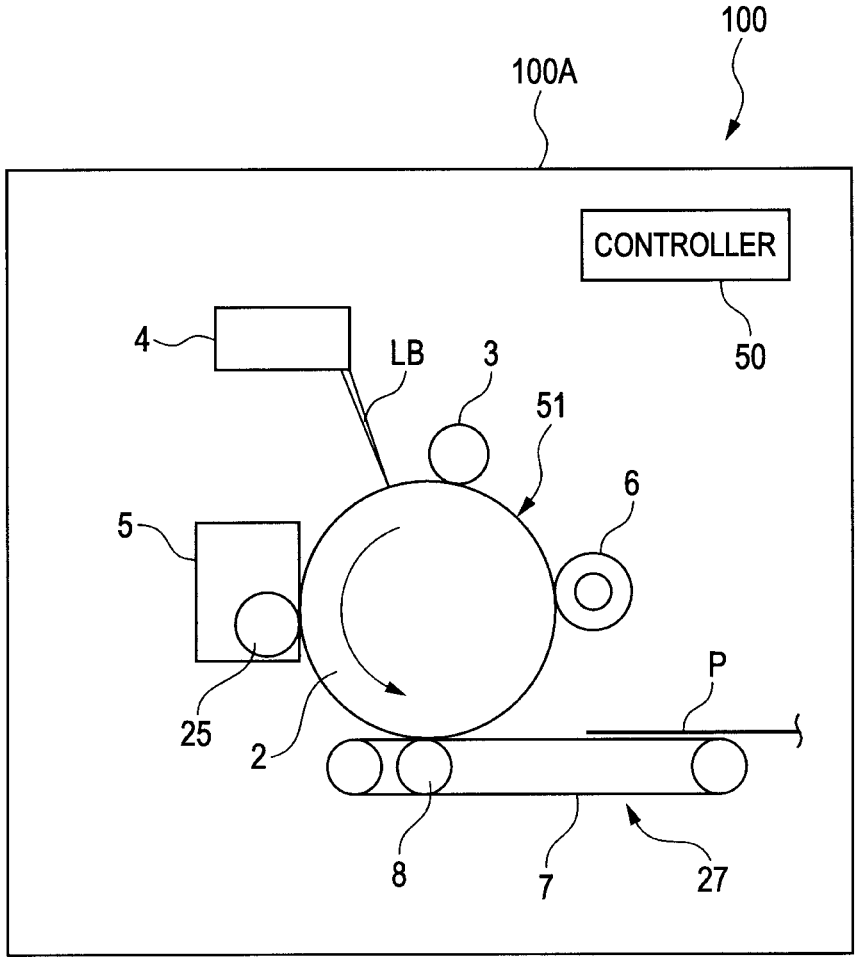
FIG. 1 is a sectional view illustrating a construction of an image forming apparatus according to a first embodiment of the present invention.

FIG. 1 is a sectional view illustrating a construction of an image forming apparatus 100 according to a first embodiment of the present invention. The image forming apparatus 100 is an image forming apparatus using an electrophotographic image forming process. As illustrated in FIG. 1, the image forming apparatus 100 includes an image forming apparatus main body (hereinafter, referred to simply as "apparatus main body") 100A, and an image forming section 51 configured to form an image is provided inside the apparatus main body 100A. The image forming section 51 includes a photosensitive drum 2 being an "image bearing member" and a transfer roller 8 being a "transfer device". At least the photosensitive drum 2 may be included in a process cartridge, and the process cartridge may be mounted in the apparatus main body 100A.

The photosensitive drum 2 being the "image bearing member" is rotated in the direction indicated by the arrow. A charging roller 3 serving as a charging member being charging means, a laser scanning device 4 serving as an image writing device being image writing means, a developing device 5 being a developing unit, a transfer device 27 being transfer means, and a cleaning device 6 are arranged around the photosensitive drum 2 in the stated order. The photosensitive drum 2 being the "image bearing member" is a drum that can bear an electrostatic image and a developer image. The charging roller 3 is a roller for charging the photosensitive drum 2 to a predetermined potential. The laser scanning device 4 is a device configured to write an electrostatic image to the surface of the photosensitive drum 2. The developing device 5 is a device configured to develop (visualizing) the electrostatic image formed on the surface of the photosensitive drum 2 with toner. The transfer device 27 includes a transfer belt 7 for conveying a transferring material P and a transfer roller 8 for transferring the developer image developed by the developing device 5 onto the transferring material P. The cleaning device 6 cleans off untransferred toner on the surface of the photosensitive drum 2.

An image forming process of the image forming apparatus 100 will be described. First, the charging roller 3 charges the surface of the photosensitive drum 2 to minus (−), and then the laser scanning device 4 writes an electrostatic image corresponding to a recorded image to the surface of the photosensitive drum 2 with a laser beam LB. After that, the developing device 5 visualizes the electrostatic image by developing the electrostatic image with toner charged to minus (−).

Meanwhile, the transfer belt 7 conveys the transferring material P to a transfer part at a predetermined timing. Then, a toner image on the surface of the photosensitive drum 2 is transferred from the photosensitive drum 2 onto the transferring material P by having a transfer bias applied thereto by the transfer roller 8 and the charged transfer belt 7. Note that, the transfer device 27 including the transfer belt 7 and the transfer roller 8 applies a transfer field to the transferring material P so as to exhibit an opposite polarity (+) to a charge polarity of toner.

A controller 50 controls the drive of the respective devices of the apparatus main body 100A including the photosensitive drum 2, the charging roller 3, the laser scanning device 4, the developing device 5, the transfer device 27, and the cleaning device 6 that are described above. The controller 50 controls the drive of a toner replenishing device 22 (see FIG. 2A) based on detection results of a toner sensor 21 (see FIG. 2A) to replenish the developing device 5 with toner. Further, as a principle, the controller 50 drives the toner replenishing device 22 to cause the developing device 5 to be replenished with toner during a developing device driving time for driving the developing device 5. Note that, the developing device driving time corresponds to an image forming period during which a developing roller 25 is opposed to an image area in which the electrostatic image is formed on the photosensitive drum 2. In addition, as a principle, the controller 50 stops the drive of the toner replenishing device 22 during a developing device suspension period for stopping the drive of the developing device 5 to stop replenishing the developing device 5 with the toner. Note that, the developing device suspension period corresponds to a non-image forming period during which the developing roller 25 is opposed to a non-image area in which the electrostatic image is not formed on the photosensitive drum 2.

Figure 2A:
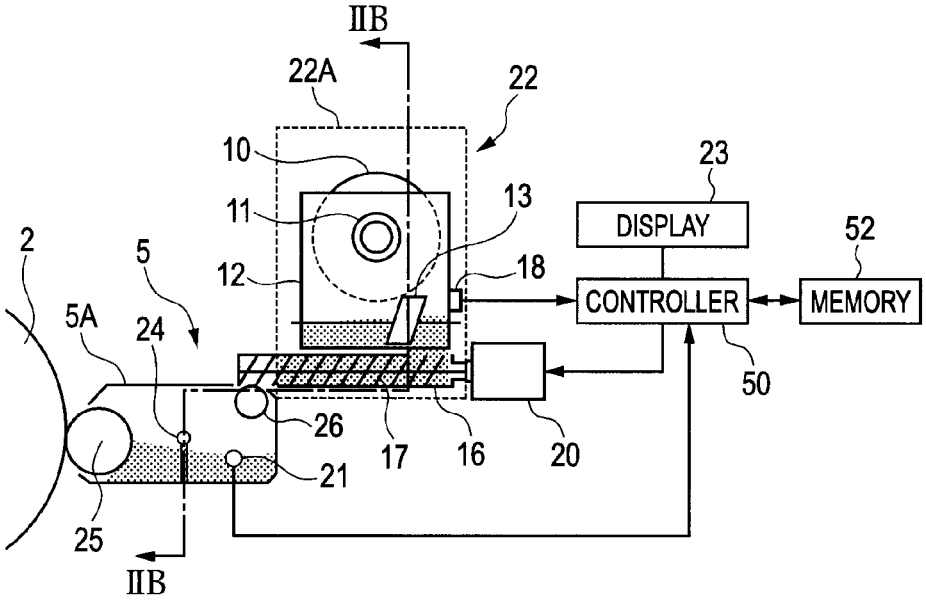
FIG. 2A is an enlarged sectional view illustrating construction of a developing device and a toner replenishing device configured to replenish the developing device with toner.

FIG. 2A is an enlarged sectional view illustrating construction of the developing device 5 and the toner replenishing device 22 for replenishing the developing device 5 with toner. As illustrated in FIG. 2A, the developing device 5 being the "developing unit" is located so as to be opposed to the surface of the photosensitive drum 2. Further, the toner replenishing device 22 being a "toner replenishing unit" for replenishing the developing device 5 with toner is coupled to the developing device 5. The developing device 5 includes, inside a developing device main body 5A, the developing roller 25, an agitating member 24, the toner sensor 21 being "detecting unit", and a conveying screw 26 for conveying toner replenished from the toner replenishing device 22 to from one end of the developing roller 25 to the other end thereof in a longitudinal direction of the developing roller 25. The developing roller 25 is disposed so as to be opposed to the photosensitive drum 2 in a non-contacting manner, and the electrostatic image on the surface of the photosensitive drum 2 is developed by causing the toner carried by the developing roller 25 to fly to the photosensitive drum 2 due to an alternating electric field applied to the developing roller 25. Further, the agitating member 24 is a member for agitating and conveying the toner received inside the developing device main body 5A toward the developing roller 25. Further, the toner sensor 21 being a "detecting unit" is a sensor provided inside the developing device 5, for detecting an amount of the toner inside the developing device 5. The developing device 5 is driven during the period (developing device driving time) during which the "image area" on the photosensitive drum 2 passes a development position, the developing roller 25 is rotated to develop the electrostatic image on the photosensitive drum 2, and the agitating member 24 and the conveying screw are rotated to perform a toner agitating operation. Further, the developing device 5 is not driven during a period during which the "non-image area" corresponding to an inter-transferring-material gap passes the development position or a post-rotation period for stabilizing the potential of the surface of the photosensitive drum 2 after the image formation, and any one of the developing roller 25, the agitating member 24, and the conveying screw 26 is not rotated (developing device suspension period).

Meanwhile, the toner replenishing device 22 includes, inside a replenishing device main body 22A, a toner bottle 10 for receiving toner, a hopper 12 for temporarily receiving the toner and successively feeding the toner to the developing device 5, and a replenishment path 16 for agitating and conveying the toner. The toner bottle 10 and the hopper 12 are connected to each other by having a delivery port 11 of the toner bottle 10 inserted into the hopper 12. The hopper 12 and the developing device main body 5A are connected to each other by the replenishment path 16. Further, an agitating member 13 is provided inside the hopper 12, and an auger 17 is provided inside the replenishment path 16. In addition, as described later, a toner sensor 18 configured to detect the amount of toner inside the hopper 12 is attached to the hopper 12.

The toner sensor 18 and the toner sensor 21 are connected to the controller 50 being a "control unit". Further, a hopper motor 20 is connected to the controller 50. The controller 50 is connected to a display 23 and a memory 52. Therefore, the controller 50 can drive the hopper motor 20 based on the detection results of the toner sensor 18. Further, the controller 50 controls the drive of the hopper motor 20 by comparison with data within the memory 52. In addition, the controller 50 can display detection information of the toner sensor 18 and drive information of the hopper motor 20 on the display 23.

The controller 50 further drives the toner replenishing device 22 based on an output of the toner sensor 21 during the developing device driving time to replenish the developing device 5 with toner. Further, in a case where a toner amount inside the developing device 5 detected by the toner sensor 21 is reduced to a level equal to or lower than a predetermined threshold value, the toner replenishing device 22 is driven to replenish the developing device 5 with toner even during the developing device suspension period during which the rotation drive of the developing device 5 is supposed to be stopped. The case where the toner amount inside the developing device 5 detected by the toner sensor 21 is reduced to a level equal to or lower than the predetermined threshold value is, for example, a case where a state of toner absence is continuously detected by the toner sensor 21 a predetermined number of times.

Figure 2B:
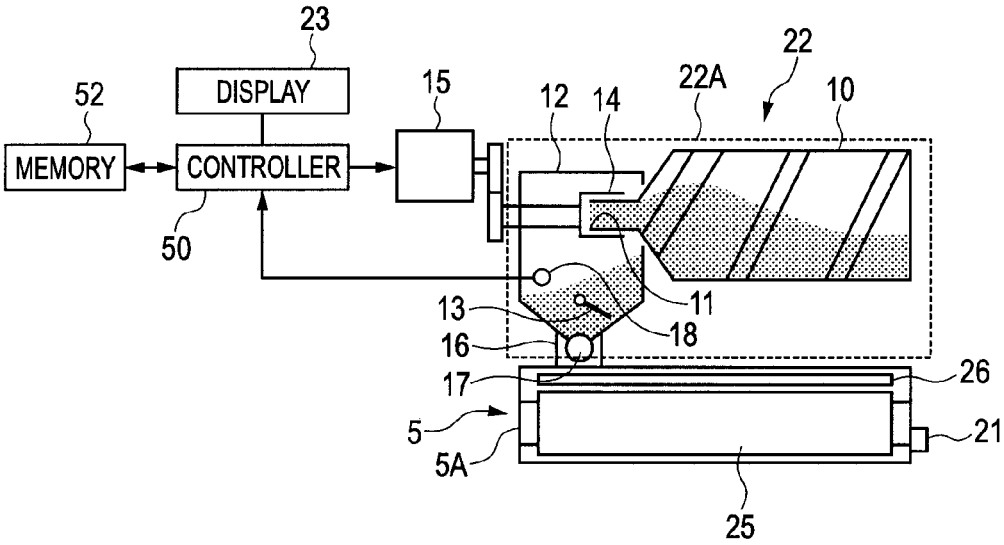
FIG. 2B is a sectional view taken along the line IIB-IIB of FIG. 2A.

FIG. 2B is a sectional view taken along the line IIB-IIB of FIG. 2A. As illustrated in FIG. 2B, the toner sensor 18 configured to detect the amount of toner inside the hopper 12 is attached inside the hopper 12. The toner sensor 18 is connected to the controller 50. The controller 50 can determine the presence or absence of toner inside the hopper 12 based on an output signal from the toner sensor 18. The toner bottle 10 has an end portion attached to a bottle motor 15 via a gear train attached to a shaft of a coupling 14.

If the controller 50 determines that the toner is absent inside the hopper 12 based on the output signal from the toner sensor 18, the controller 50 causes the bottle motor 15 to rotate so as to feed the toner inside the toner bottle 10 to the delivery port 11 and replenish the inside of the hopper 12 with the toner.

Further, the hopper 12 and the developing device 5 are connected to each other via the replenishment path 16 provided in the toner replenishing device 22. The auger 17 is rotatably supported inside the replenishment path 16. The hopper motor 20 (see FIG. 2A) is attached to an end portion of the auger 17. The controller 50 drives the hopper motor 20 to rotate the auger 17 so as to replenish the developing device 5 with the toner inside the hopper 12.

The hopper motor 20 is driven to supply toner intermittently (repeating ON for 0.5 seconds and OFF for 0.5 seconds) only while the developing device 5 is driven (developing device driving time), and if the developing device 5 is stopped during this cycle, continues a state before the stop to carry out intermittent replenishment. Then, the toner supplied to the developing device 5 is conveyed to the developing roller 25 by the rotation of the agitating member 24.

Figure 3A:
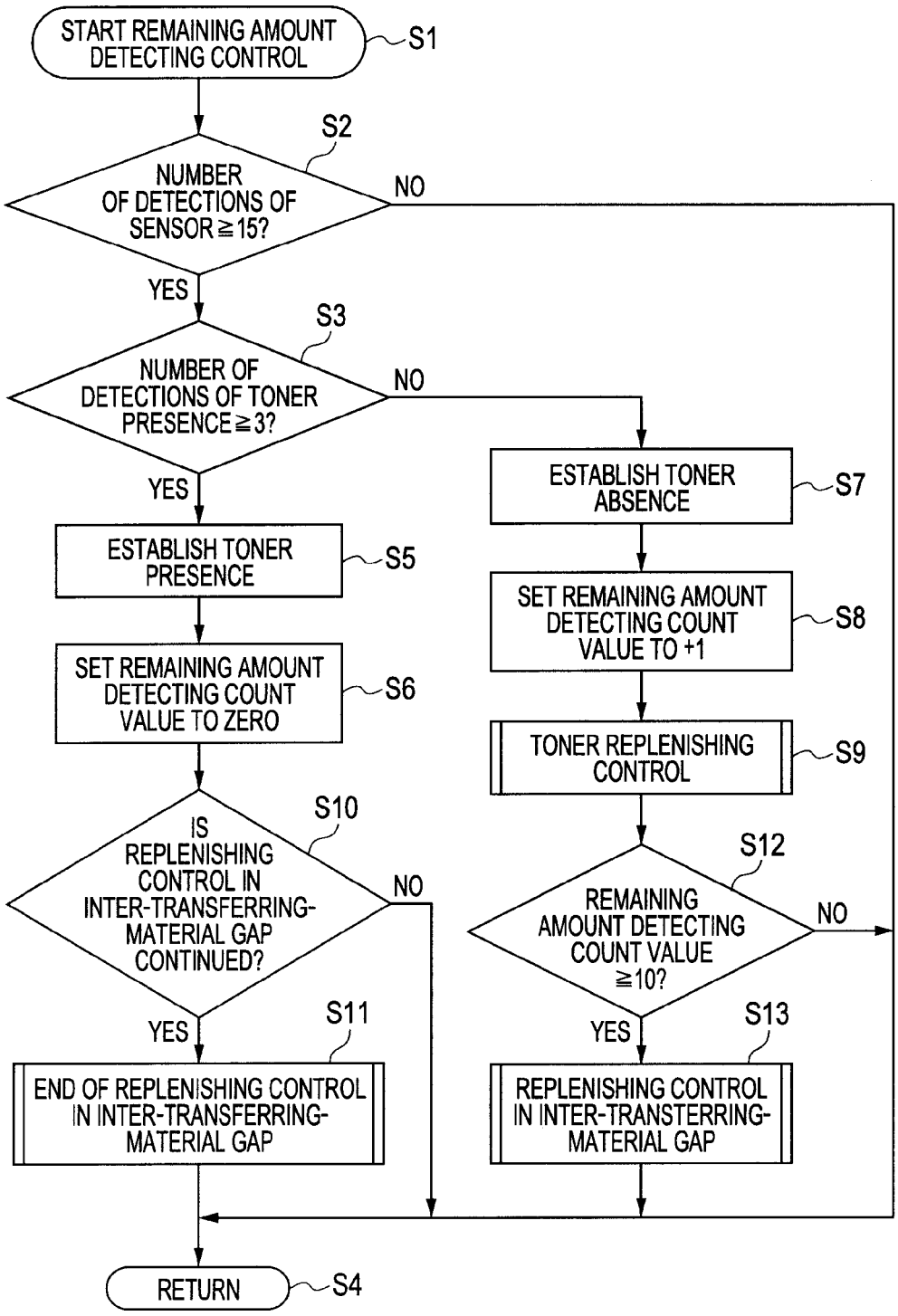
FIGS. 3A and 3B are flowcharts illustrating control process steps performed by a controller.

FIG. 3A is a flowchart illustrating control process steps performed by the controller 50 according to the first embodiment of the present invention. The toner sensor 21 detects the toner remaining amount inside the developing device 5 every 100 msec, and the controller 50 predefines a threshold value according to the number of detections in one cycle of the agitating member 24. Here, the toner sensor 21 detects the presence or absence of toner fifteen times in one cycle of the agitating member 24. If the controller 50 determines based on the detection results of the toner sensor 21 that the presence of toner has been detected less than three times, the controller 50 determines that the toner is absent. Then, the controller intermittently drives the hopper motor 20 to convey toner to the developing device 5. Hereinafter, FIG. 3A is referenced to specifically describe the details of the control process steps performed by the controller 50.

The controller 50 starts detecting control of the toner remaining amount (S1). The controller 50 determines whether or not the number of detections of the toner sensor 21 is equal to or larger than fifteen (S2). If the determination of Step S2 results in "Yes", the controller 50 determines based on the detection results of the toner sensor 21 whether or not the number of detections of the toner presence is three or more (S3). If the determination of Step S2 results in "No", the controller 50 returns to the start of the control process steps of Step S1 (S4).

If the determination of Step S3 results in "Yes", the controller 50 establishes the toner presence inside the developing device 5 (S5), and clears a remaining amount detecting counter, in other words, sets a remaining amount detecting count value to zero (S6). Here, the remaining amount detecting counter is a counter provided in the controller 50, and counts the number of times the toner absence is determined. If the determination of Step S3 results in "No", the controller 50 establishes the toner absence inside the developing device 5 (S7). The controller 50 then changes a detecting count value of the toner remaining amount set in a memory inside the controller 50 by +1 (S8), and controls the replenishment of toner (S9). This toner replenishing operation will be described later with reference to FIG. 3B. The counting up is thus repeated until the toner presence inside the developing device 5 is detected. In other words, as long as the number of detections of toner presence is less than three (S3), a control cycle of Steps S7 to S9, S12, S13, S4, and S1 to S3 is repeated.

After the process step of Step S6, the controller 50 determines whether or not the replenishing control in the inter-transferring-material gap is continued (S10). If the determination of Step S10 results in "Yes", the controller 50 ends the replenishing control in the inter-transferring-material gap after a lapse of a predetermined time (S11), and returns to the start of the control process steps of Step S1 (S4). If the determination of Step S10 results in "No", the controller 50 returns to the start of the control process steps of Step S1 (S4).

After the process step of Step S9, the controller 50 determines whether or not the remaining amount detecting count value is ten or more (S12). If the determination of Step S12 results in "Yes", the controller 50 determines that a toner supply amount from the hopper 12 cannot follow a toner consumption amount inside the developing device 5. Then, the controller 50 drives the developing device 5 and the hopper motor 20 in the inter-transferring-material gap to control so that the toner replenishing device 22 replenishes the developing device 5 with toner (S13). If the determination of Step S12 results in "No", the controller 50 returns to the start of the control process steps of Step S1 (S4).

Figure 3B:
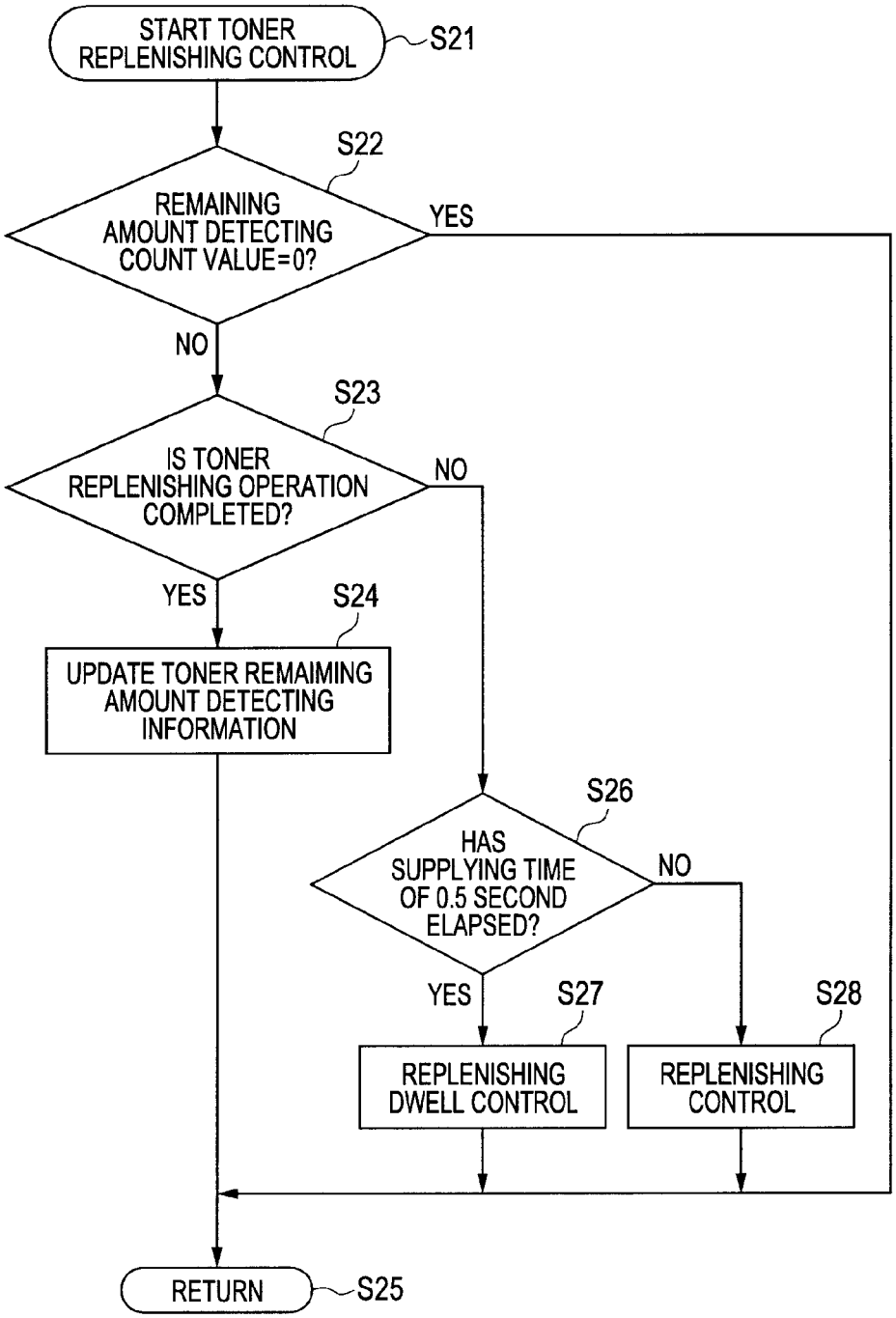

FIG. 3B is a flowchart of control process steps for the toner replenishing of Step S9. The controller 50 starts a toner replenishing control (S21). The controller 50 determines whether or not the remaining amount detecting count value is zero (S22). If the determination of Step S22 results in "No", the controller 50 determines whether or not the toner replenishing control is completed (S23). If the determination of Step S23 results in "Yes", the controller 50 updates toner remaining amount detection information (S24), and returns to the start of the control process steps of Step S21 (S25). If the determination of Step S23 results in "No", the controller 50 determines whether or not a supplying time of 0.5 seconds has lapsed (S26). If the determination of Step S26 results in "Yes", the controller 50 performs replenishing dwell control (S27), and returns to the start of the control process steps of Step S21 (S25). If the determination of Step S26 results in "No", the controller 50 performs the replenishing control (S28), and returns to the start of the control process steps of Step S21 (S25).

Next, examination is made to a difference in results of experiments conducted by control of a controller between a comparison example and the first embodiment. First, FIGS. 4A and 4B are referenced to describe the results of the experiments conducted by the control of the controller of an image forming apparatus according to the comparison example (conventional example). Note that, in the case of the image forming apparatus according to the comparison example, the developing device 5 is always stopped during the developing device suspension period during which the drive of the developing device 5 is supposed to be stopped. Note that, in the comparison example, the experiments were conducted in an environment at normal temperature and normal humidity by using an engine of "IR3225" manufactured by Canon Inc.

FIG. 4A is a table showing a length (mm) in a conveying direction, a process speed (mm/sec), a time (sec) in a transferring material, and a time (sec) of no developing drive in the inter-transferring-material gap with regard to the transferring materials P of A4 size and A3 size used in the image forming apparatus according to the comparison example. Further, FIG. 4A is a table showing a developing device driving time per sheet (sec/sheet), a toner consumption amount per sheet (g), and a maximum value (g/sec) and a minimum value (g/sec) of a toner supply amount with regard to the transferring materials P of A4 size and A3 size. In other words, the image forming apparatus according to the comparison example is different from the image forming apparatus according to the first embodiment in that the developing device is not driven in the inter-transferring-material gap. Note that, referring to FIG. 4A, in a case where continuous printing is performed at a high coverage rate (50%), it is possible to supply toner in a gap between the transferring materials P. Therefore, if the process speed becomes high, a follow-up property of the toner inside the developing device 5 cannot be ensured.

As illustrated in FIG. 4A, in the case of the transferring material P of A4 size, when the process speed is 135 mm/sec, the toner consumption amount per sheet is 0.50 g, the developing device driving time is 1.56 sec/sheet, and the toner consumption amount per unit time is 0.32 g/sec. In contrast, the maximum value of the toner supply amount per unit time is 1.00 g/sec, and the minimum value is 0.56 g/sec. In this case, the toner supply amount per unit time is larger than the toner consumption amount per unit time. Therefore, the toner supply amount sufficiently follows the toner consumption amount.

However, in the case of the transferring material P of A4 size, when the process speed is 230 mm/sec, the toner consumption amount per sheet is 0.50 g, the developing device driving time is 0.91 sec/sheet, and the toner consumption amount per unit time is 0.55 g/sec. In contrast, the maximum value of the toner supply amount per unit time is 0.50 g/sec, and the minimum value is 0.41 g/sec. In this case, the toner supply amount per unit time is smaller than the toner consumption amount per unit time. Therefore, the toner supply amount fails to sufficiently follow the toner consumption amount.

Further, in the case of the transferring material P of A4 size, when the process speed is 310 mm/sec, the toner consumption amount per sheet is 0.50 g, the developing device driving time is 0.68 sec/sheet, and the toner consumption amount per unit time is 0.73 g/sec. In contrast, the maximum value of the toner supply amount per unit time is 0.50 g/sec, and the minimum value is 0.18 g/sec. In this case, the toner supply amount per unit time is smaller than the toner consumption amount per unit time. Therefore, the toner supply amount fails to sufficiently follow the toner consumption amount.

Similarly, as illustrated in FIG. 4A, in the case of the transferring material P of A3 size, when the process speed is 135 mm/sec, the toner consumption amount per unit time is 0.32 g/sec (1.00 g÷3.11 sec). In contrast, the maximum value of the toner supply amount per unit time is 1.61 g/sec, and the minimum value is 1.50 g/sec. In this case, the toner supply amount per unit time is larger than the toner consumption amount per unit time. Therefore, the toner supply amount sufficiently follows the toner consumption amount.

However, in the case of the transferring material P of A3 size, when the process speed is 230 mm/sec, the toner consumption amount per unit time is 0.55 g/sec (1.00 g÷1.83 sec). In contrast, the maximum value of the toner supply amount per unit time is 1.50 g/sec, and the minimum value is 0.83 g/sec. In this case, the toner supply amount per unit time is larger than the toner consumption amount per unit time. Therefore, the toner supply amount sufficiently follows the toner consumption amount.

Further, in the case of the transferring material P of A3 size, when the process speed is 310 mm/sec, the toner consumption amount per unit time is 0.74 g/sec (1.00 g÷1.35 sec). In contrast, the maximum value of the toner supply amount per unit time is 0.84 g/sec, and the minimum value is 0.50 g/sec. In this case, the toner consumption amount per unit time is smaller than the maximum value of the toner supply amount per unit time but larger than the minimum value. Therefore, the toner supply amount may fail to sufficiently follow the toner consumption amount in some cases.

FIG. 4B is a table showing the number of printed sheets and a toner consumption amount along with the number of printed sheets and a toner consumption amount per sheet (g) for cases of 135 mm/sec, 230 mm/sec, and 310 mm/sec with regard to the transferring material P of A4 size. Specifically, FIG. 4B is a table showing a relationship among the toner supply amount (g) with respect to the toner consumption amount, a difference (Δ) obtained by subtracting the toner consumption amount from the toner supply amount, a toner amount (g), and a percentage (%) of the toner amount.

For example, in the case where the process speed is 135 mm/sec with the number of printed sheets being 100, the toner consumption amount is 50 g, the toner supply amount is 77.8 g, the difference obtained by subtracting the toner consumption amount from the toner supply amount is 27.8 g, the toner amount is 195.7 g, and a follow-up rate is 100%. Therefore, the toner supply amount can sufficiently follow the toner consumption amount.

Further, in the case where the process speed is 310 mm/sec with the number of printed sheets being 100, the toner consumption amount is 50 g, the toner supply amount is 33.85 g, the difference obtained by subtracting the toner consumption amount from the toner supply amount is −16.15 g, the toner amount is 183.9 g, and the follow-up rate is 92%. Therefore, the toner supply amount cannot sufficiently follow the toner consumption amount.

Figure 5:
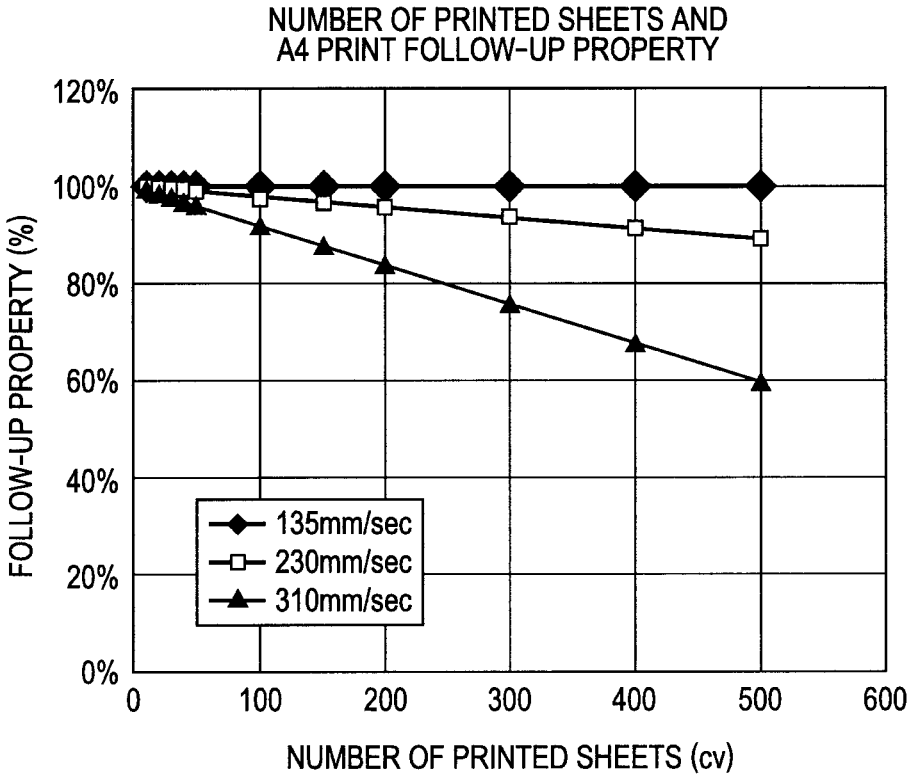
FIG. 5 is a graph illustrating a relationship between a follow-up property indicating how a toner supply amount follows the toner consumption amount and the number of printed sheets in a case of the image forming apparatus according to the comparison example.

FIG. 5 is a graph illustrating a relationship between the follow-up property indicating how the toner supply amount follows the toner consumption amount and the number of printed sheets. As illustrated in FIG. 5, the follow-up property tends to be reduced as printing speed increases, but an extent to which the follow-up property is reduced becomes larger as the printing speed increases.

FIG. 6A is a table showing a length (mm) in a conveying direction, a process speed (mm/sec), a time (sec/sheet) in a transferring material, and a time (sec) of developing drive in the inter-transferring-material gap with regard to the transferring materials P of A4 size and A3 size used in the image forming apparatus 100 according to the first embodiment.

The time (sec/sheet) in the transferring material is a time required to convey a length equivalent to one sheet of the transferring material. The time of developing drive in the inter-transferring-material gap is, in other words, a time during which the toner replenishing is carried out. FIG. 6A shows the developing device driving time per sheet (sec), the toner consumption amount per sheet (g), and the maximum value (g/sec) and the minimum value (g/sec) of the toner supply amount with regard to the transferring materials P of A4 size and A3 size. Note that, referring to FIG. 6A, in the case where the continuous printing is performed at the high coverage rate (50%), it is possible to supply toner in the gap between the transferring material P and the subsequent transferring material P. Therefore, compared to the comparison example illustrated in FIG. 4A, in a case where the process speed becomes high, the follow-up property of the toner inside the developing device 5 is ensured at 230 mm/sec and 310 mm/sec.

As illustrated in FIG. 6A, in the case of the transferring material P of A4 size, when the process speed is 135 mm/sec, the toner consumption amount per sheet is 0.50 g, the developing device driving time is 1.70 sec/sheet, and the toner consumption amount per unit time is 0.29 g/sec. In contrast, the maximum value of the toner supply amount per unit time is 1.20 g/sec, and the minimum value is 0.70 g/sec. In this case, the toner supply amount per unit time is larger than the toner consumption amount per unit time. Therefore, the toner supply amount sufficiently follows the toner consumption amount. Note that, "time in a transferring material" may also be referred to as "period within a transferring material".

Further, in the case of the transferring material P of A4 size, when the process speed is 230 mm/sec, the toner consumption amount per sheet is 0.50 g, the developing device driving time is 1.00 sec/sheet, and the toner consumption amount per unit time is 0.50 g/sec. In contrast, the maximum value of the toner supply amount per unit time is 0.50 g/sec, and the minimum value is 0.50 g/sec. In this case, the toner consumption amount per unit time is the same as the toner supply amount per unit time. However, the follow-up property indicating how the toner supply amount follows the toner consumption amount is further improved than in the case of the comparison example (see FIG. 4B and FIG. 6B).

Further, in the case of the transferring material P of A4 size, when the process speed is 310 mm/sec, the toner consumption amount per sheet is 0.50 g, the developing device driving time is 0.76 sec/sheet, and the toner consumption amount per unit time is 0.66 g/sec. In contrast, the maximum value of the toner supply amount per unit time is 0.50 g/sec, and the minimum value is 0.26 g/sec. In this case, the toner consumption amount per unit time is larger than the toner supply amount per unit time. However, the follow-up property indicating how the toner supply amount follows the toner consumption amount is further improved than in the case of the comparison example (see FIG. 4B and FIG. 6B).

Similarly, in the case of the transferring material P of A3 size, when the process speed is 135 mm/sec, the toner consumption amount per unit time is 0.31 g/sec (1.00 g÷3.25 sec). In contrast, the maximum value of the toner supply amount per unit time is 1.75 g/sec, and the minimum value is 1.50 g/sec. In this case, the toner supply amount per unit time is larger than the toner consumption amount per unit time. Therefore, the toner supply amount sufficiently follows the toner consumption amount.

Similarly, in the case of the transferring material P of A3 size, when the process speed is 230 mm/sec, the toner consumption amount per unit time is 0.52 g/sec (1.00 g÷1.92 sec). In contrast, the maximum value of the toner supply amount per unit time is 1.50 g/sec, and the minimum value is 0.92 g/sec. In this case, the toner supply amount per unit time is larger than the toner consumption amount per unit time. Therefore, the toner supply amount sufficiently follows the toner consumption amount.

Similarly, in the case of the transferring material P of A3 size, when the process speed is 310 mm/sec, the toner consumption amount per unit time is 0.70 g/sec (1.00 g÷1.43 sec). In contrast, the maximum value of the toner supply amount per unit time is 0.93 g/sec, and the minimum value is 0.50 g/sec. In this case, the toner consumption amount per unit time is smaller than the maximum value of the toner consumption amount per unit time but larger than the minimum value. Therefore, the toner supply amount may fail to sufficiently follow the toner consumption amount in some cases. With regard to this case, the follow-up property indicating how the toner supply amount follows the toner consumption amount is further improved than in the case of the comparison example (see FIG. 4B and FIG. 6B).

FIG. 6B is a table showing the number of printed sheets and a toner consumption amount along with the number of printed sheets and a toner consumption amount per sheet (g) for cases of 135 mm/sec, 230 mm/sec, and 310 mm/sec with regard to the transferring material P of A4 size. Specifically, FIG. 6B is a table showing a relationship among the toner supply amount (g) with respect to the toner consumption amount, a difference (Δ) obtained by subtracting the toner consumption amount from the toner supply amount, a toner amount (g), and a percentage (%) of the toner amount.

For example, in the case where the printing speed is 135 mm/sec with the number of printed sheets being 100, the toner consumption amount is 50 g, the toner supply amount is 95 g, the difference obtained by subtracting the toner consumption amount from the toner supply amount is 45 g, the toner amount is 200 g, and a follow-up rate is 100%. Therefore, the toner supply amount can sufficiently follow the toner consumption amount.

Further, in the case where the printing speed is 310 mm/sec with the number of printed sheets being 100, the toner consumption amount is 50 g, the toner supply amount is 38 g, the difference obtained by subtracting the toner consumption amount from the toner supply amount is −12 g, the toner amount is 188 g, and the follow-up rate is 94%. Therefore, the toner supply amount cannot sufficiently follow the toner consumption amount. However, the follow-up property indicating how the toner supply amount follows the toner consumption amount is further improved than in the case of the comparison example (see FIG. 4B and FIG. 6B).

Figure 7A:
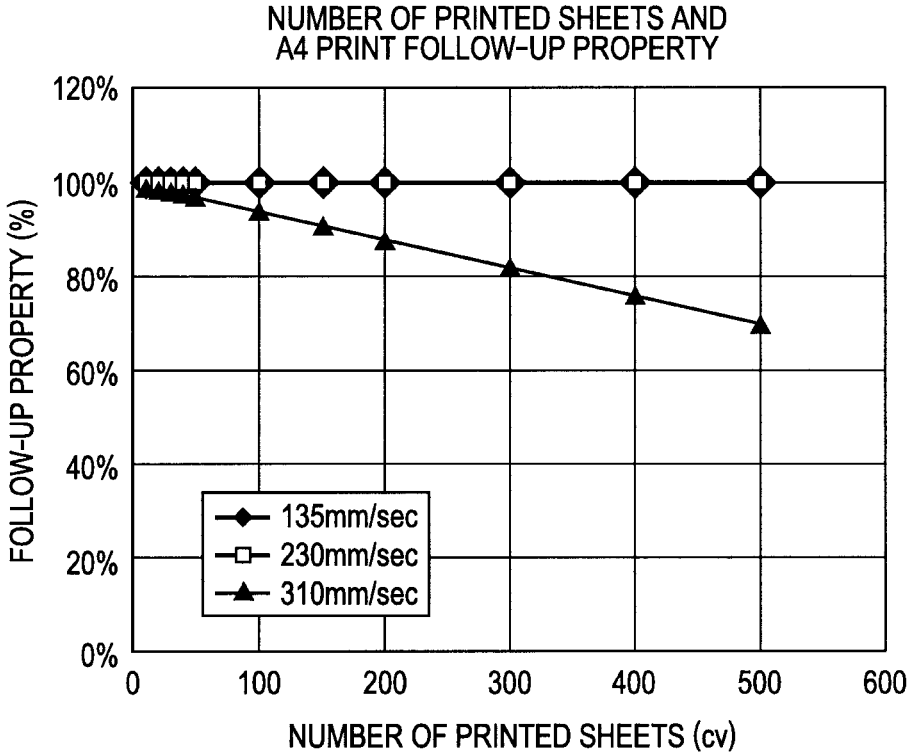
FIG. 7A is a graph illustrating the relationship between the follow-up property indicating how the toner supply amount follows the toner consumption amount and the number of printed sheets.

FIG. 7A is a graph illustrating a relationship between the follow-up property indicating how the toner supply amount follows the toner consumption amount and the number of printed sheets. As illustrated in FIG. 7A, the follow-up property tends to be reduced as printing speed increases, but an extent to which the follow-up property is reduced as the printing speed increases becomes smaller than in the case of the comparison example illustrated in FIG. 5.

Figure 7B:
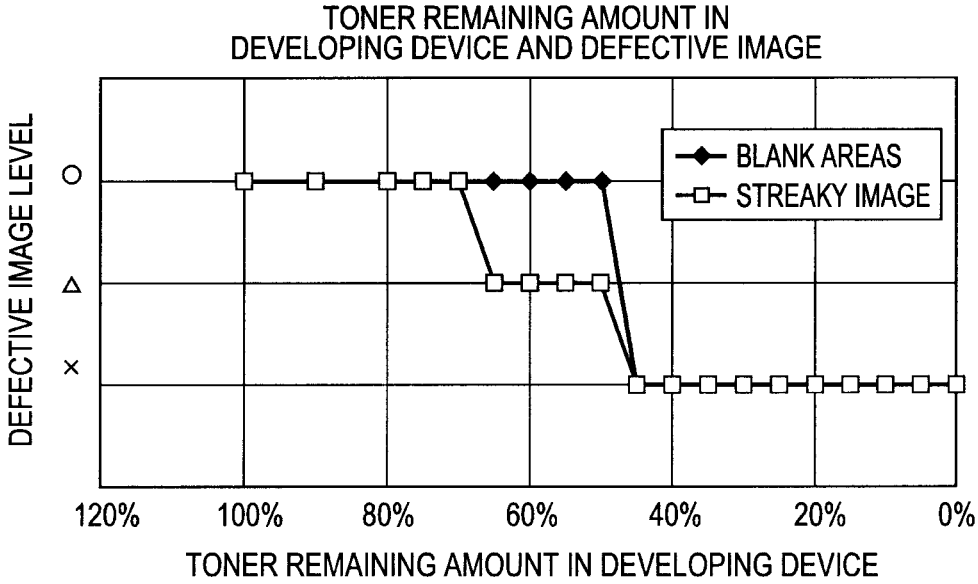
FIG. 7B is a graph illustrating a relationship between a defective image level and a toner remaining amount in the developing device.

FIG. 7B is a graph illustrating a relationship between a defective image level and the toner remaining amount inside the developing device 5. A defective image such as a "streaky image" or a "blank area" is generated depending on the toner remaining amount inside the developing device 5. Here, the "streaky image" represents a state in which an uneven image density due to uneven bearing amounts of toner is generated in a direction perpendicular to the conveying direction of the transferring material, and a state in which line images such as characters are decipherable. Further, the "blank area" represents a state in which an area on which no toner is borne is generated in the direction perpendicular to the conveying direction of the transferring material, and a state in which line images such as characters are indecipherable. As illustrated in FIG. 7B, in a case where the toner remaining amount inside the developing device 5 is 70% or more, the "streaky image" is generated to some extent, but the defective image level is 0 (better). Also in a case where the toner remaining amount inside the developing device is 45% or more and less than 70%, the "blank area" is hardly generated with a defective image level of ○ (better), and the defective image level in terms of the "streaky image" is Δ (good). In a case where the toner remaining amount inside the developing device is 45% or less, the "streaky image" and the "blank area" are generated, and the defective image level is × (no good).

According to this embodiment, in the case where the state of toner absence is continuously detected by the detecting unit a predetermined number of times, the developing unit is driven even during the non-image forming period, during which the toner replenishing unit replenishes the developing unit with toner. Therefore, the follow-up property indicating how a toner supply amount follows a toner consumption amount is improved to suppress an occurrence of the defective image.

Second Embodiment

Figures 8, 8A:
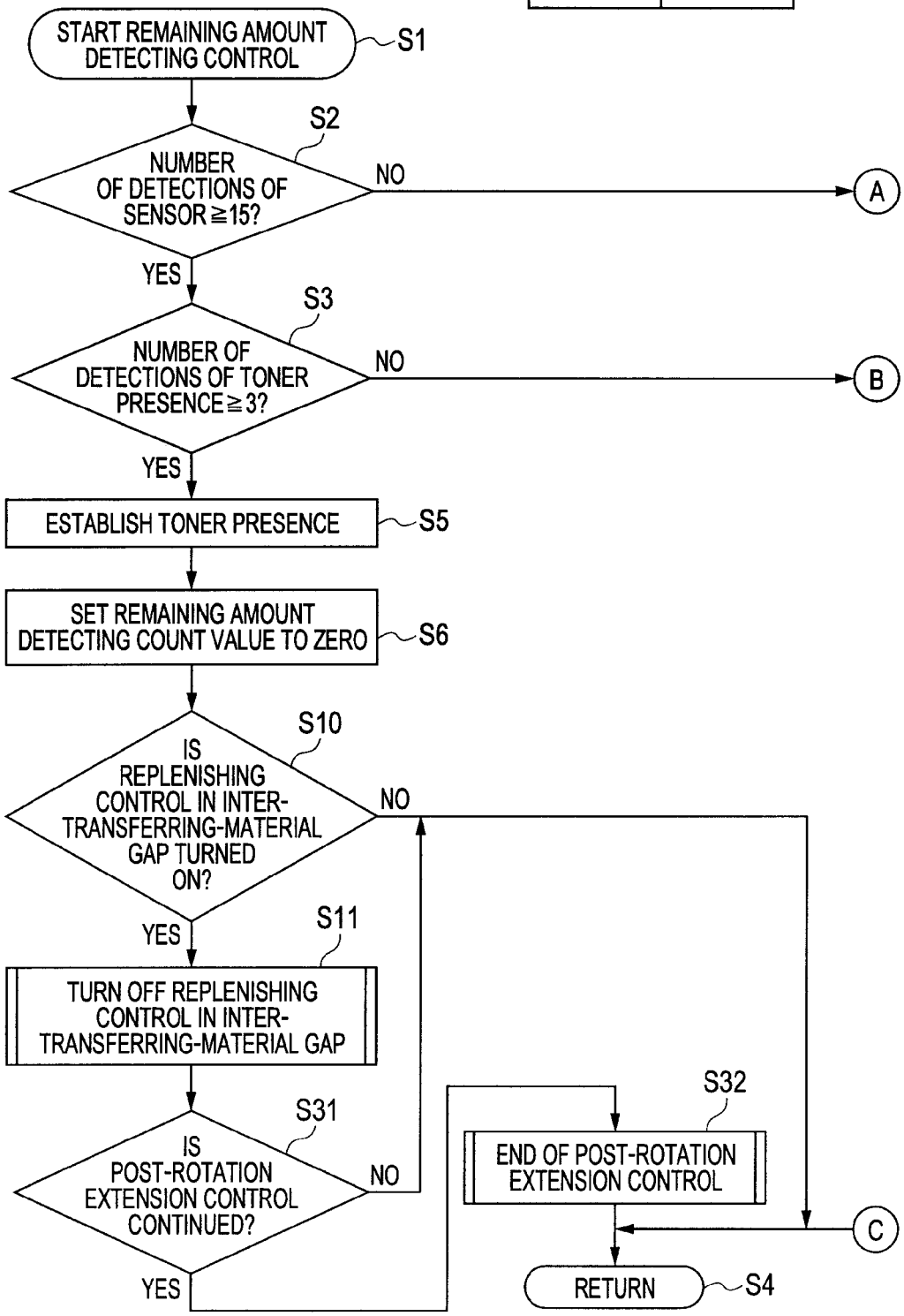
FIG. 8 which is composed of FIGS. 8A and 8B are flowcharts illustrating control process steps performed by a controller provided in an image forming apparatus according to a second embodiment.
Figure 8B:
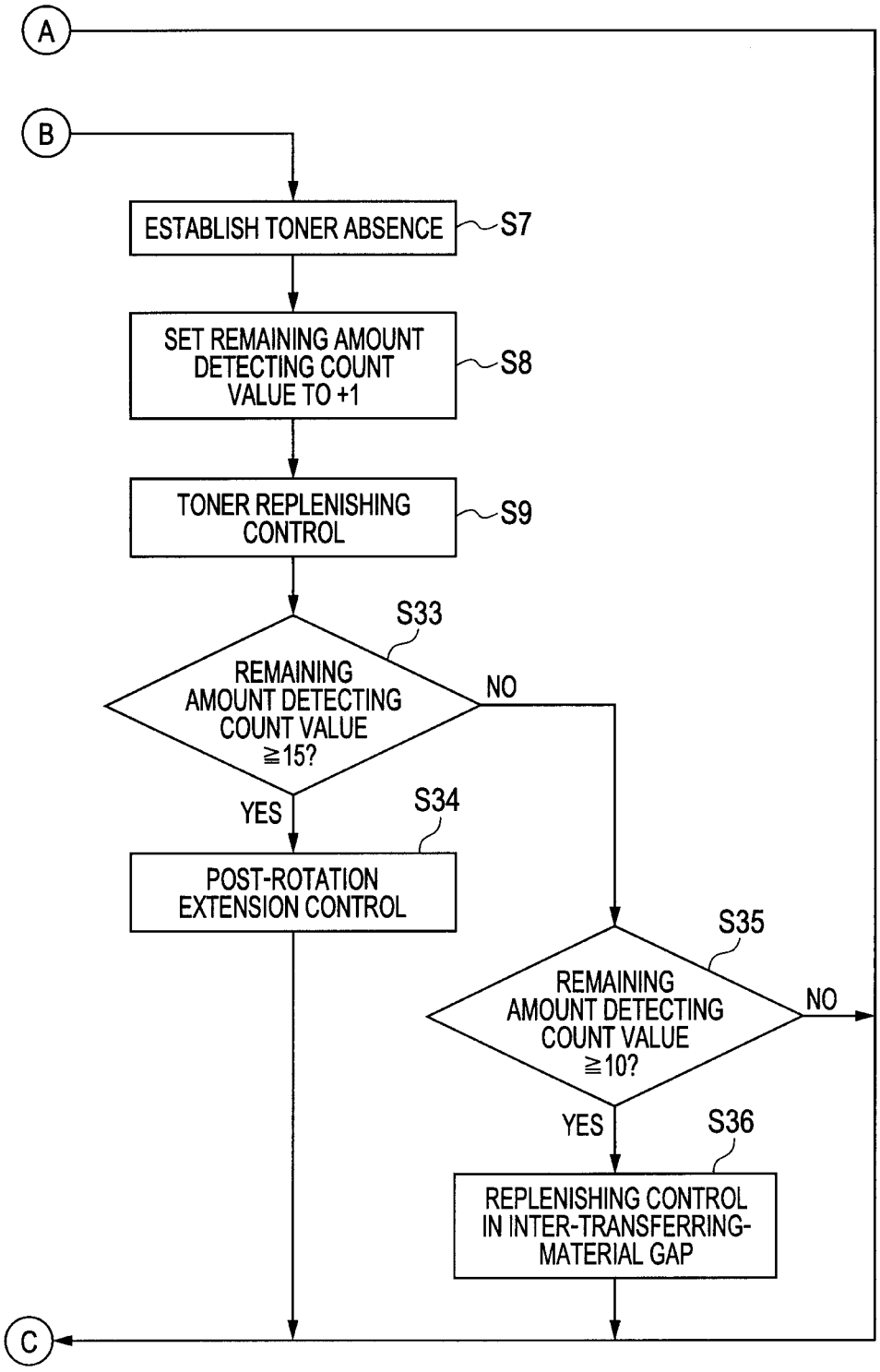

FIGS. 8A and 8B are flowcharts illustrating control process steps performed by a controller provided in an image forming apparatus according to a second embodiment. In the construction of the second embodiment, the same components and effects as those of the first embodiment are denoted by the same reference symbols, and descriptions thereof are omitted as appropriate. Among the control process steps according to the second embodiment, the same control process steps as those of the first embodiment are denoted by the same reference symbols, and descriptions thereof are omitted as appropriate. The descriptions of the control process steps performed by the controller 50 according to the first embodiment are used for the process steps denoted by the same reference symbols. The second embodiment can also be applied to the same image forming apparatus as that of the first embodiment, and hence a description of the image forming apparatus is omitted.

The controller according to the second embodiment is different from the controller 50 according to the first embodiment in the following points. Specifically, if the toner amount inside the developing device 5 detected by the toner sensor 21 is reduced to a level equal to or lower than a predetermined threshold value, the controller 50 according to the second embodiment extends a post-rotation time for rotation performed after the continuous printing on the transferring materials P is completed. Then, the controller 50 drives the developing device 5 during the post-rotation time, and causes the toner replenishing device 22 to replenish the developing device 5 with toner while the developing device 5 is driven. This allows the toner supply amount to follow the toner consumption amount inside the developing device 5.

In the second embodiment, if the remaining amount detecting count value is ten or more, the controller 50 determines that the toner supply amount from the hopper 12 can no longer follow the toner consumption amount inside the developing device 5. Then, the controller 50 drives the developing device 5 in the inter-transferring-material gap to carry out the toner replenishing in the inter-transferring-material gap, and clears the remaining amount detecting counter if the toner presence is determined based on an output signal from the toner sensor 21 inside the developing device 5. In addition, if the remaining amount detecting count value is counted up to fifteen, the controller 50 extends the post-rotation time after the completion of the printing operation by ten seconds, drives the developing device 5 during the post-rotation time, and replenishes the developing device 5 with toner. Hereinafter, FIGS. 8A and 8B are referenced to specifically describe the details of the control process steps.

After the toner replenishing control is performed in the inter-transferring-material gap (S11), the controller 50 determines whether or not a post-rotation extension control is continued (S31). If the determination of Step S31 results in "Yes", after a lapse of a predetermined time, the controller 50 ends the post-rotation extension control (S32), and returns to the start of the control process steps of Step S1 (S4).

Further, after the controller 50 turns off the toner replenishing control (S9), the controller 50 determines whether or not the remaining amount detecting count value is fifteen or more (S33). If the determination of Step S33 results in "Yes", the controller 50 starts the post-rotation extension control (S34), and returns to the start of the control process steps of Step S1 (S4). If the determination of Step S33 results in "No", the controller 50 determines whether or not the remaining amount detecting count value is ten or more (S35). If the determination of Step S35 results in "Yes", the controller 50 performs the toner replenishing control in the inter-transferring-material gap (S36), and returns to the start of the control process steps of Step S1 (S4). If the determination of Step S35 results in "No", the controller 50 returns to the start of the control process steps of Step S1 (S4).

FIG. 9A is a table showing a length (mm) in a conveying direction, a process speed (mm/sec), a time in a transferring material (sec), and a time (sec) of developing drive in the inter-transferring-material gap with regard to the transferring materials P of A4 size and A3 size. Further, FIG. 9A is a table showing a developing device driving time per sheet (sec/sheet), a toner consumption amount per sheet (g), and a maximum value (g/sec) and a minimum value (g/sec) of a toner supply amount with regard to the transferring materials P of A4 size and A3 size. Note that, referring to FIG. 9A, in a case where continuous printing is performed at a high coverage rate (50%), it is possible to replenish toner in the inter-transferring-material gap and to extend the post-rotation time for rotation performed after the continuous printing by ten seconds, to thereby replenish the developing device 5 with the toner. Therefore, compared to the comparison example illustrated in FIG. 4A, if the process speed becomes high, a follow-up property of the toner inside the developing device 5 is ensured.

As illustrated in FIG. 9A, in the case of the transferring material P of A4 size, when the process speed is 135 mm/sec, the toner consumption amount per sheet is 0.50 g, the developing device driving time is 6.70 sec/sheet, and the toner consumption amount per unit time is 0.07 g/sec. In contrast, the maximum value of the toner supply amount per unit time is 1.20 g and the minimum value is 0.70 g/sec. In this case, the toner supply amount per unit time is larger than the toner consumption amount per unit time. Therefore, the toner supply amount sufficiently follows the toner consumption amount. In addition, a toner replenishing amount after printing is +5 g.

However, in the case of the transferring material P of A4 size, when the process speed is 230 mm/sec, the toner consumption amount per sheet is 0.50 g, the developing device driving time is 6.00 sec/sheet, and the toner consumption amount per unit time is 0.08 g/sec. In contrast, the maximum value of the toner supply amount per unit time is 0.50 g/sec and the minimum value is 0.50 g/sec. In this case, the toner supply amount per unit time is larger than the toner consumption amount per unit time. Therefore, the toner supply amount sufficiently follows the toner consumption amount. In addition, a toner replenishing amount after printing is +5 g.

Further, in the case of the transferring material P of A4 size, when the process speed is 310 mm/sec, the toner consumption amount per sheet is 0.50 g, the developing device driving time is 5.76 sec/sheet, and the toner consumption amount per unit time is 0.09 g/sec. In contrast, the maximum value of the toner supply amount per unit time is 0.50 g and the minimum value is 0.26 g/sec. In this case, the toner supply amount per unit time is larger than the toner consumption amount per unit time. Therefore, the toner supply amount sufficiently follows the toner consumption amount. In addition, a toner replenishing amount after printing is +5 g.

Similarly, as illustrated in FIG. 9A, in the case of the transferring material P of A3 size, when the process speed is 135 mm/sec, the toner consumption amount per unit time is 0.12 g/sec (1.00 g÷8.25 sec). In contrast, the maximum value of the toner supply amount per unit time is 1.75 g/sec and the minimum value is 1.50 g/sec. In this case, the toner supply amount per unit time is larger than the toner consumption amount per unit time. Therefore, the toner supply amount sufficiently follows the toner consumption amount. In addition, a toner replenishing amount after printing is +5 g.

Further, in the case of the transferring material P of A3 size, when the process speed is 230 mm/sec, the toner consumption amount per unit time is 0.14 g/sec (1.00 g÷6.92 sec). In contrast, the maximum value of the toner supply amount per unit time is 1.50 g/sec and the minimum value is 0.92 g/sec. In this case, the toner supply amount per unit time is larger than the toner consumption amount per unit time. Therefore, the toner supply amount sufficiently follows the toner consumption amount. In addition, a toner replenishing amount after printing is +5 g.

Similarly, in the case of the transferring material P of A3 size, when the process speed is 310 mm/sec, the toner consumption amount per unit time is 0.16 g/sec (1.00 g÷6.43 sec). In contrast, the maximum value of the toner supply amount per unit time is 0.93 g/sec and the minimum value is 0.50 g/sec. In this case, the toner supply amount per unit time is larger than the toner consumption amount per unit time. Therefore, the toner supply amount sufficiently follows the toner consumption amount. In addition, a toner replenishing amount after printing is +5 g.

FIG. 9B is a table showing the number of printed sheets and a toner consumption amount along with the number of printed sheets and a toner consumption amount per sheet (g) for cases of 135 mm/sec, 230 mm/sec, and 310 mm/sec with regard to the transferring material of A4 size. Further, FIG. 9B is a table showing a relationship among the toner supply amount (g), a difference (Δ) obtained by subtracting the toner consumption amount from the toner supply amount, a toner amount (g), and a percentage (%) of the toner amount with respect to the values of FIG. 9B.

For example, in the case where the printing speed is 135 mm/sec with the number of printed sheets being 100, the toner consumption amount is 50 g, the toner supply amount is 95 g, the difference obtained by subtracting the toner consumption amount from the toner supply amount is 45 g, the toner amount is 200 g, and a follow-up rate is 100%. Therefore, the toner supply amount can sufficiently follow the toner consumption amount.

Further, in the case where the printing speed is 310 mm/sec with the number of printed sheets being 100, the toner consumption amount is 50 g, the toner supply amount is 38 g, the difference obtained by subtracting the toner consumption amount from the toner supply amount is −7 g, the toner amount is 193 g, and the follow-up rate is 97%. Therefore, the toner supply amount can sufficiently follow the toner consumption amount.

Figure 10:
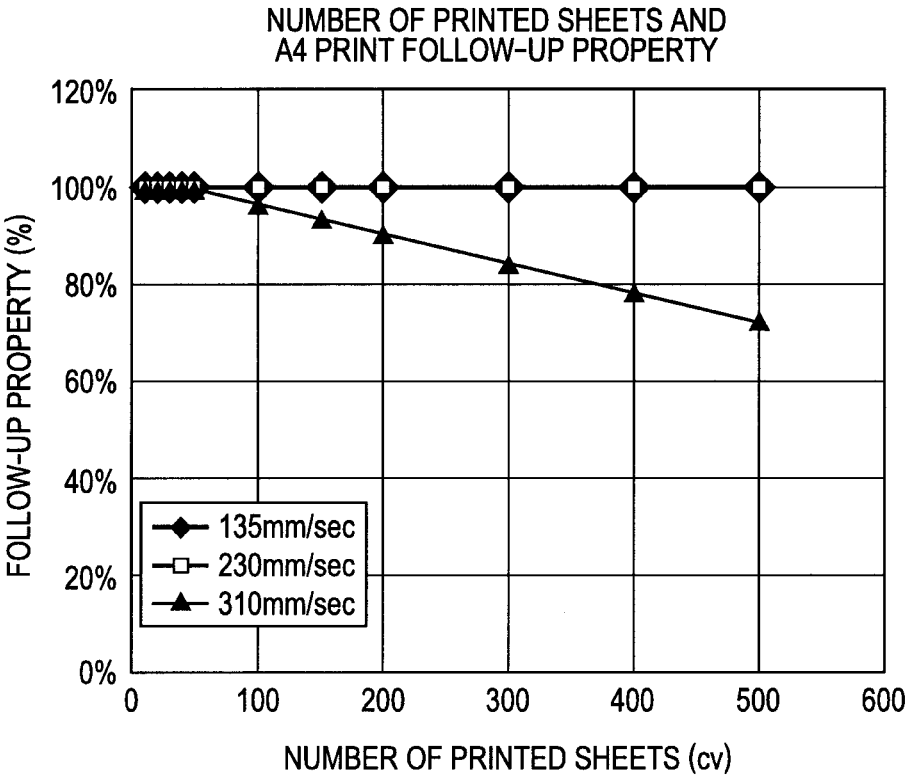
FIG. 10 is a graph illustrating the relationship between the follow-up property indicating how the toner supply amount follows the toner consumption amount and the number of printed sheets.

FIG. 10 is a graph illustrating a relationship between the follow-up property indicating how the toner supply amount follows the toner consumption amount and the number of printed sheets. As illustrated in FIG. 10, the follow-up property tends to be reduced as printing speed increases, but an extent to which the follow-up property is reduced as the printing speed increases becomes smaller than in the case of the comparison example illustrated in FIG. 5.

Third Embodiment

Figures 11, 11A:
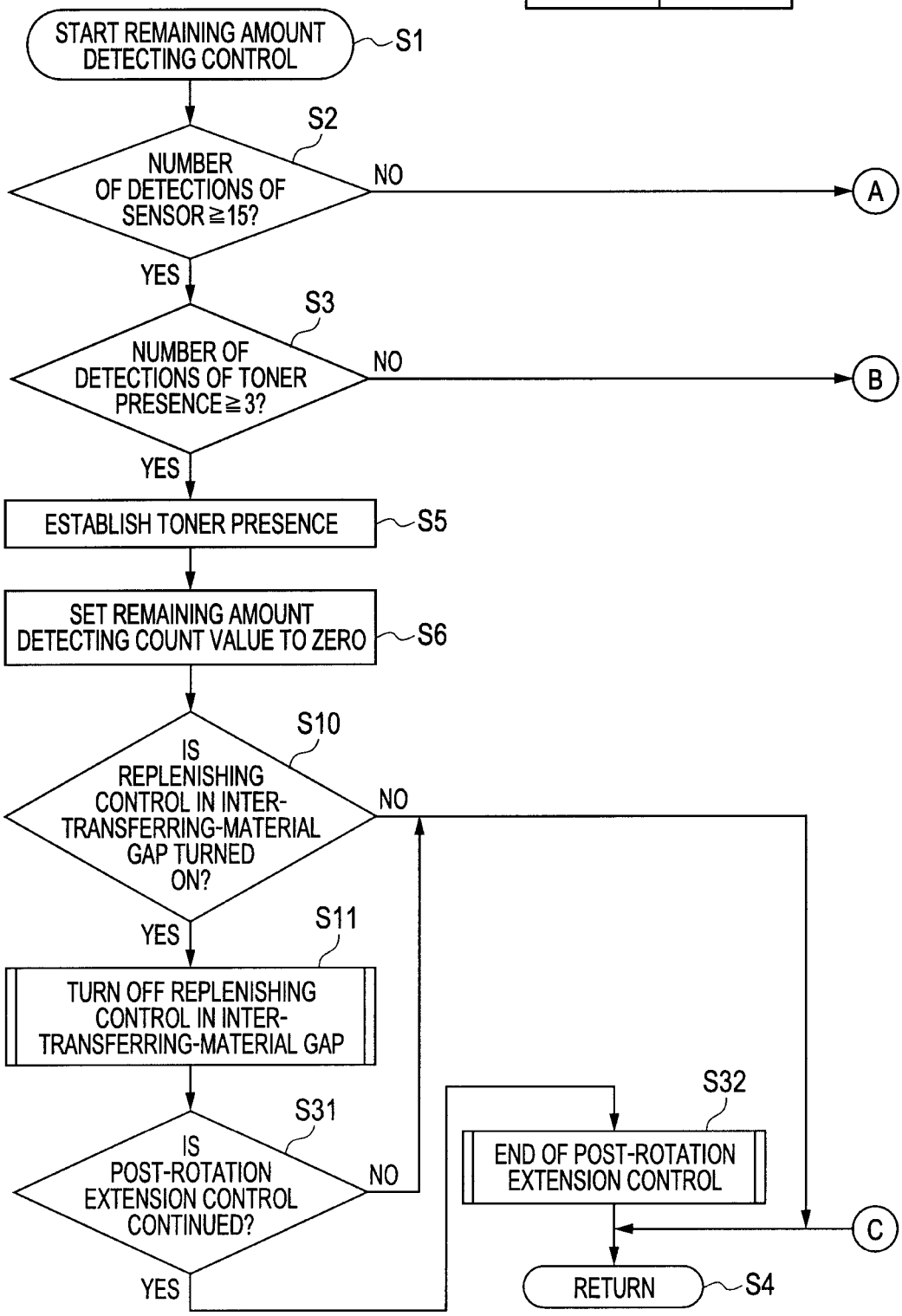
FIG. 11 which is composed of FIGS. 11A and 11B are flowcharts illustrating control process steps performed by a controller provided in an image forming apparatus according to a third embodiment.
Figure 11B:
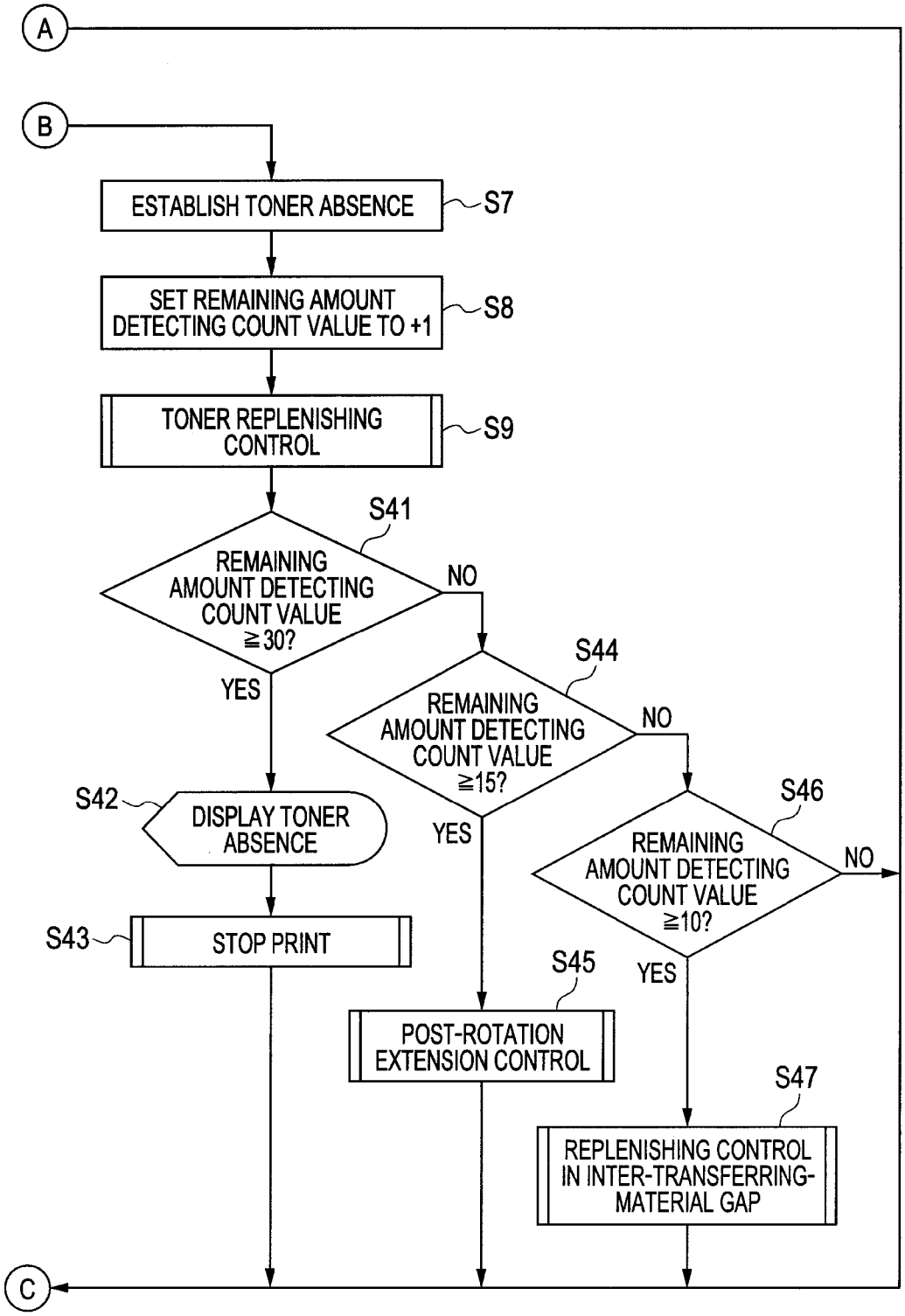

FIGS. 11A and 11B are flowcharts illustrating control process steps performed by a controller 50 provided in an image forming apparatus according to a third embodiment. In the construction of the third embodiment, the same components and effects as those of the first and second embodiments are denoted by the same reference symbols, and descriptions thereof are omitted as appropriate. Among the control process steps according to the third embodiment, the same control process steps as those of the first and second embodiments are denoted by the same reference symbols, and descriptions thereof are omitted. The descriptions of the control process steps performed by the controller 50 according to the first and second embodiments are used for the process steps denoted by the same reference symbols. The third embodiment can also be applied to the same image forming apparatus 100 as those of the first and second embodiments, and hence a description of the image forming apparatus is omitted.

The third embodiment is different from the first and second embodiments in the following points. Specifically, if the toner amount inside the developing device 5 detected by the toner sensor 21 is reduced to a level equal to or lower than a predetermined threshold value, the controller 50 according to the third embodiment determines that the toner becomes absent inside the toner replenishing device 22. Then, the controller 50 stops the printing performed on the transferring material P, and notifies that the toner becomes absent inside the toner replenishing device 22. The controller 50 displays that there is no toner remaining amount left inside the toner bottle 10 within the image forming apparatus 100 on the display 23 based on the value of the remaining amount detecting counter, and stops the image forming apparatus 100.

If the remaining amount detecting counter reaches thirty even if the above-mentioned operation according to the first and second embodiments is repeated, the controller 50 determines the toner absence, and displays the toner absence on the display 23. And, the controller 50 does not receive subsequent printing operations after the printing currently in operation is completed. This allows the toner amount inside the developing device 5 to be maintained at a predetermined level and the toner absence of the image forming apparatus 100 to be detected with accuracy. Hereinafter, FIGS. 11A and 11B are referenced to specifically describe the control process steps performed by the controller 50.

After the controller 50 performs the toner replenishing control (S9), the controller 50 determines whether or not the remaining amount detecting count value is thirty or more (S41). If the determination of Step S41 results in "Yes", the controller 50 determines the toner absence (S42), stops printing (S43), and returns to the start of the control process steps of Step S1 (S4). If the determination of Step S41 results in "No", the controller 50 determines whether or not the remaining amount detecting count value is fifteen or more (S44).

If the determination of Step S44 results in "Yes", the controller 50 performs the post-rotation extension control (S45), and then returns to the start of the control process steps of Step S1 (S4). If the determination of Step S44 results in "No", the controller 50 determines whether or not the remaining amount detecting count value is ten or more (S46). If the determination of Step S46 results in "Yes", the controller 50 performs the toner replenishing control in the inter-transferring-material gap (S47), and then returns to the start of the control process steps of Step S1 (S4). If the determination of Step S46 results in "No", the controller 50 returns to the start of the control process steps of Step S1 (S4).

Fourth Embodiment

Figures 12, 12A:
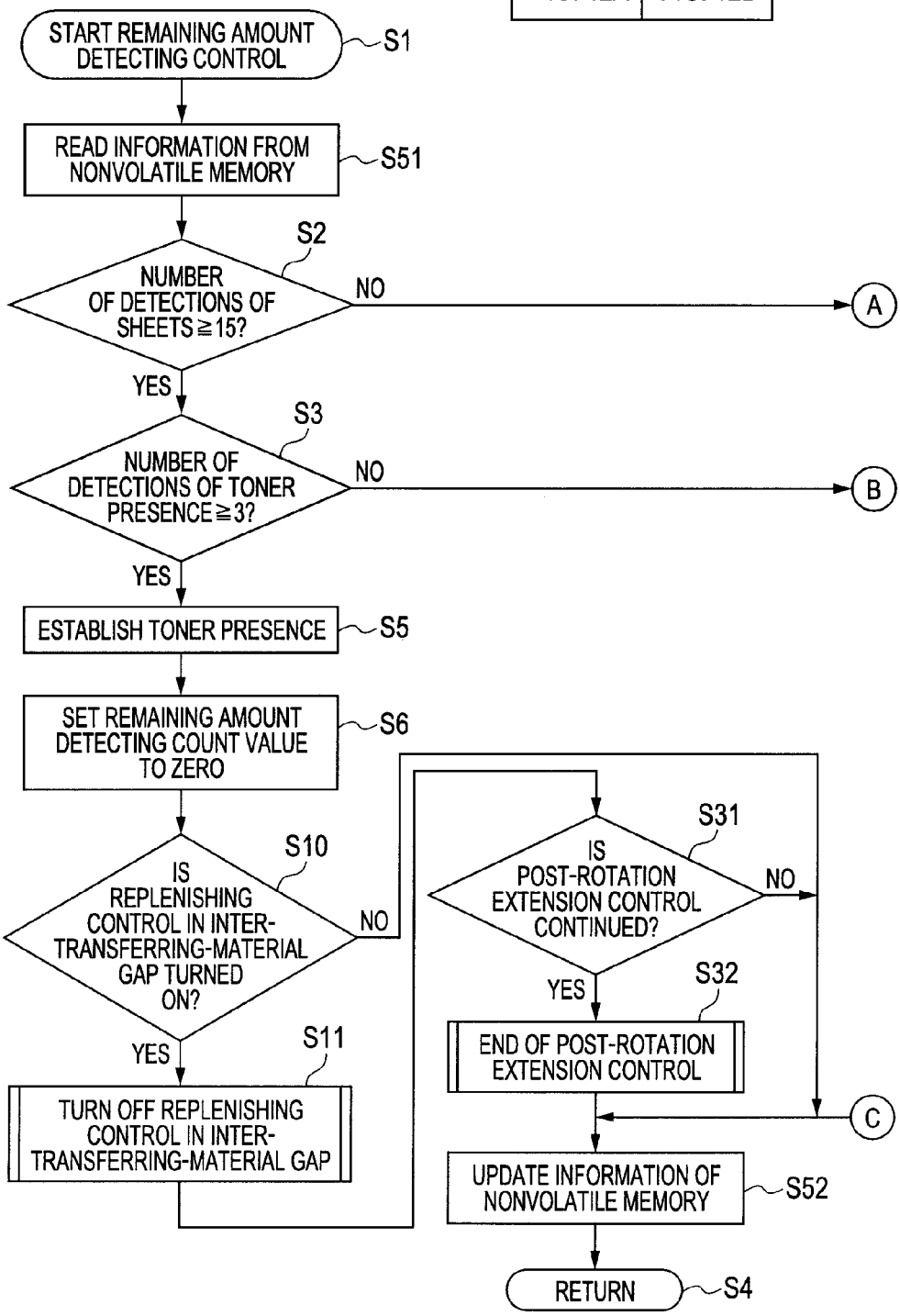
FIG. 12 which is composed of FIGS. 12A and 12B are flowcharts illustrating control process steps performed by a controller provided in an image forming apparatus according to a fourth embodiment.
Figure 12B:
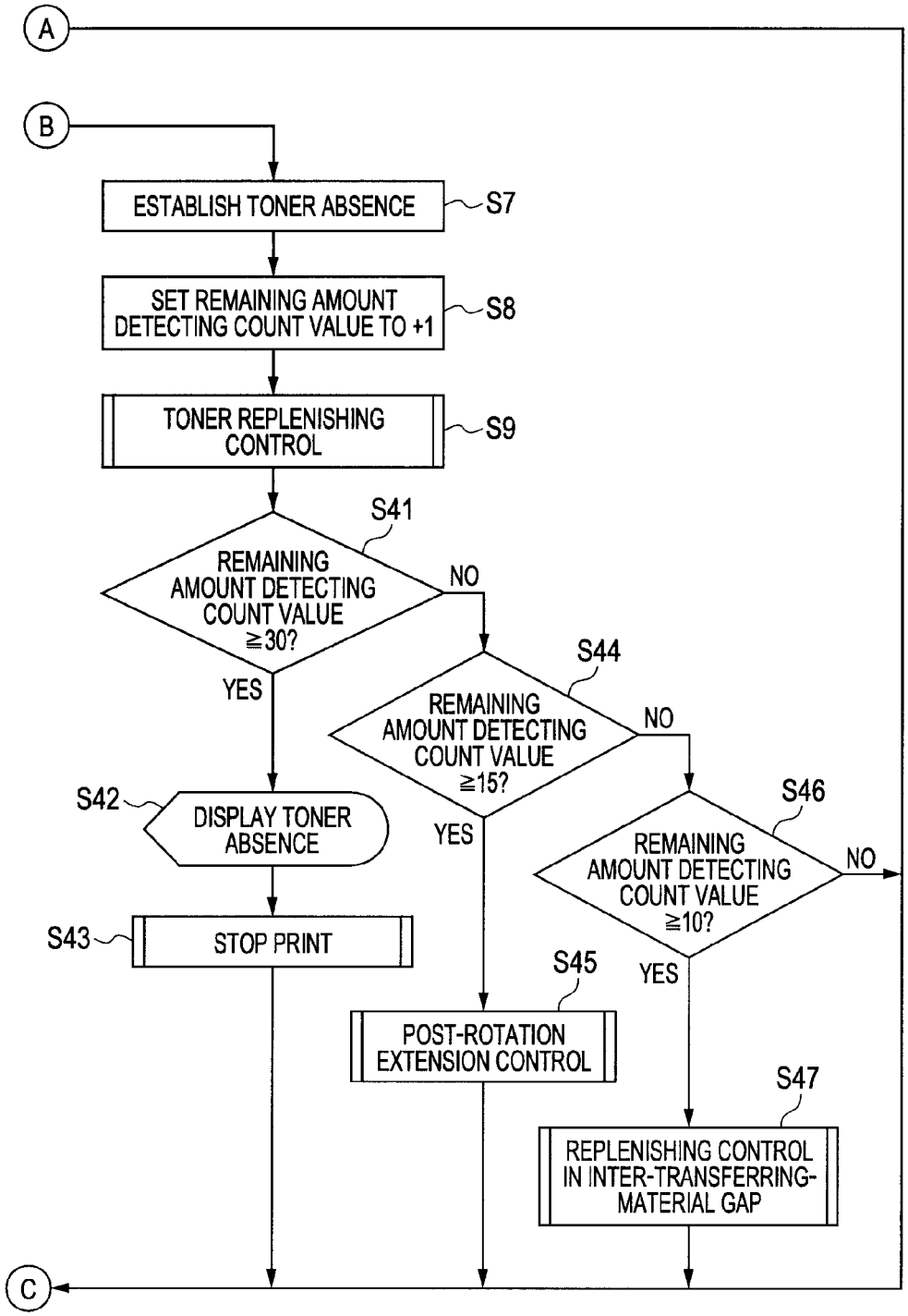

FIGS. 12A and 12B are flowcharts illustrating control process steps performed by a controller provided in an image forming apparatus according to a fourth embodiment. In the construction of the fourth embodiment, the same components and effects as those of the first to third embodiments are denoted by the same reference symbols, and descriptions thereof are omitted as appropriate. Among the control process steps according to the fourth embodiment, the same control process steps as those of the first to third embodiments are denoted by the same reference symbols, and descriptions thereof are omitted as appropriate. The descriptions of the control process steps performed by the controller 50 according to the first to third embodiments are used for the process steps denoted by the same reference symbols. The fourth embodiment can also be applied to the same image forming apparatus as those of the first to third embodiments, and hence a description of the image forming apparatus is omitted.

The controller 50 according to the fourth embodiment is different from the controller 50 according to the first to third embodiments in the following points. Specifically, the controller 50 according to the fourth embodiment includes a memory that is mounted to the toner replenishing device 22 and capable of writing and reading data, and stores in the memory a remaining amount counter indicating the toner amount inside the developing device 5. With this configuration, even if the toner replenishing device 22 is replaced while in use, the controller 50 can keep recognizing the accurate toner amount inside the developing device 5.

Specifically, a nonvolatile memory (not shown) is mounted to the toner bottle 10. Further, by having the remaining amount detecting counter stored in the nonvolatile memory, even if the toner bottle 10 is replaced while in use, the controller 50 can accurately determine the toner absence inside the toner bottle 10 when the use is restarted.

The present invention is not limited to a one-component development method and a two-component development method, and the nonvolatile memory mounted to the toner bottle 10 can be used in both wired and wireless manners. Further, the toner sensor 21 provided in the developing device 5 may be a sensor configured to detect a mixing ratio of toner used in the two-component development method, or may be detecting means for determining the toner remaining amount by using a density detecting patch formed on a transfer belt. FIGS. 12A and 12B are referenced to describe the control process steps performed by the controller 50.

After the controller 50 starts the detecting control of the toner remaining amount (S1), information on the toner remaining amount in the toner bottle 10 is read from the nonvolatile memory of the toner bottle 10. After the post-rotation extension control is ended (S32), the controller 50 updates the information of the nonvolatile memory (S52), and returns to the start of the control process steps of Step S1 (S4).

With the constructions according to the first to fourth embodiments, if the toner amount inside the developing device 5 is reduced to a level equal to or lower than a predetermined threshold value, the developing device is driven even while the developing device 5 is originally supposed to stop, and during that time, the toner replenishing device 22 replenishes the developing device 5 with toner. Therefore, the toner amount inside the developing device 5 is maintained at a predetermined level, which prevents a phenomenon that a ratio of new toner to the toner inside the developing device 5 increases sharply. As a result, the defective image, which is generated due to the fact that the toner supply amount fails to follow the toner consumption amount, is prevented from being generated.

Note that, even when the printing is performed continuously at the high coverage rate, the toner supply amount to the developing device 5 is caused to follow the toner consumption amount consumed by the developing device 5, and a phenomenon that an alert of the toner absence is displayed on a display even when toner is present inside the toner bottle 10 and the hopper 12 is prevented. Further, the defective image, which is generated due to the toner decreasing inside the developing device 5, is prevented from being generated.

As described above, the "case where the toner amount inside the developing device 5 is reduced to a level equal to or lower than a predetermined threshold value" refers to a "case where the controller 50 determines based on the output signal from the toner sensor 21 inside the developing device 5 that the toner remaining amount inside the developing device 5 is equal to or smaller than a predefined remaining amount". Further, in the above-mentioned case where "the developing device 5 is driven even while the developing device 5 is originally supposed to stop, and during that time, the toner replenishing device 22 replenishes the developing device 5 with toner", the controller 50 performs the following control. Specifically, as in the case of the first embodiment, even during the developing device suspension period during which the developing device 5 is normally stopped (inter-transferring-material gap at the time of the continuous printing), the controller 50 drives the developing device 5, and during that time, performs such control that the developing device 5 is replenished with toner. Alternatively, as in the case of the second embodiment, the controller 50 drives the developing device 5 during the post-rotation time after the completion of the printing operation, and performs such control that the developing device 5 is replenished with toner. Alternatively, the control may be performed by combining the above-mentioned cases of the first embodiment and the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-242038, filed Oct. 28, 2010, which is hereby incorporated by reference herein in its entirety.

What is claimed is:

1. An image forming apparatus, comprising:

an image bearing member on which an electrostatic image is formed;

a developing unit configured to develop the electrostatic image formed on the image bearing member with toner;

a toner replenishing unit configured to replenish the developing unit with the toner;

a detecting unit configured to detect an amount of toner in the developing unit; and a control unit configured to control the toner replenishing unit to perform a toner replenishing operation based on a detection result of the detecting unit, wherein the control unit causes the toner replenishing unit to perform the toner replenishing operation in a non-image forming period of the developing unit based on the detection result, which is detected by the detecting unit in an image forming period of the developing unit.

2. An image forming apparatus according to claim 1, wherein, in a case where the amount of the toner in the developing unit detected by the detecting unit is not more than a predetermined amount, the control unit causes the toner replenishing unit to perform the toner replenishing operation in the non-image forming period of the developing unit.

3. An image forming apparatus according to claim 2, wherein, in a case where the amount of toner in the developing unit detected by the detecting unit is more than the predetermined amount, the control unit prevents the toner replenishing unit from performing the toner replenishing operation in the non-image forming period of the developing unit.

4. An image forming apparatus according to claim 2, wherein, in a case where the amount of toner in the developing unit detected by the detecting unit after the toner replenishing unit performs the toner replenishing operation is not more than the predetermined amount, the control unit determines that the toner is absent in the toner replenishing unit, stops an image forming operation, and notifies that the toner is absent in the toner replenishing unit.

5. An image forming apparatus according to claim 1, wherein, in a case where the amount of toner in the developing unit detected by the detecting unit is more than a predetermined amount, the control unit prevents the toner replenishing unit from performing the toner replenishing operation in the non-image forming period of the developing unit.

6. An image forming apparatus according to claim 1, wherein, in a case where the non-image forming period is after a completion of a printing operation, the control unit extends a post-rotation time in which at least the developing unit associated with the toner replenishing unit is rotated, and causes the toner replenishing unit to perform the toner replenishing operation in the post-rotation time.

7. An image forming apparatus, comprising:

an image bearing member on which an electrostatic image is formed;

a developing unit configured to develop the electrostatic image formed on the image bearing member with toner;

a toner replenishing unit configured to replenish the developing unit with the toner;

a detecting unit configured to detect an amount of the toner in the developing unit; and a control unit configured to cause the toner replenishing unit to perform a toner replenishing operation based on a detection result of the detecting unit while driving the developing unit, wherein the control unit causes the toner replenishing unit to perform the toner replenishing operation until the detecting unit detects toner presence a first predetermined number of times in an image forming period, the control unit causes the toner replenishing unit to perform the toner replenishing operation in a non-image forming period in a case where the detecting unit detects toner absence a second predetermined number of times without detecting the toner presence the first predetermined number of times in the image forming period, and the control unit prevents the toner replenishing unit from performing the toner replenishing operation in the non-image forming period in a case where the detecting unit does not detect the toner absence the second predetermined number of times without detecting the toner presence the first predetermined number of times in the image forming period.

8. An image forming apparatus according to claim 7, wherein the non-image forming period includes a post-rotation time for which at least the developing unit is driven in a predetermined time after printing on a transferring material is completed, and wherein in a case where an amount of the toner detected by the detecting unit after an image formation is completed is further reduced to a level equal to or lower than a predetermined threshold value, the control unit extends the post-rotation time and causes the toner replenishing unit to perform the toner replenishing operation during an extended post-rotation time.

* * * * *